US011334001B2

(12) United States Patent
Luo et al.

(10) Patent No.: US 11,334,001 B2
(45) Date of Patent: May 17, 2022

(54) TONER DISCHARGING STRUCTURE AND TONER CARTRIDGE

(71) Applicant: Ninestar Corporation, Zhuhai (CN)

(72) Inventors: Qin Luo, Zhuhai (CN); Gerning Ding, Zhuhai (CN); Likun Zeng, Zhuhai (CN); Yuan Liu, Zhuhai (CN)

(73) Assignee: NINESTAR CORPORATION, Zhuhai (CN)

( * ) Notice: Subject to any disclaimer, the term of this patent is extended or adjusted under 35 U.S.C. 154(b) by 0 days.

(21) Appl. No.: 17/121,734

(22) Filed: Dec. 14, 2020

(65) Prior Publication Data

US 2021/0096484 A1 Apr. 1, 2021

Related U.S. Application Data

(63) Continuation of application No. PCT/CN2019/102159, filed on Aug. 23, 2019.

(30) Foreign Application Priority Data

Sep. 26, 2018 (CN) ..... 201821572861.7
Dec. 6, 2018 (CN) ..... 201822045022.6
(Continued)

(51) Int. Cl.
*G03G 15/08* (2006.01)

(52) U.S. Cl.
CPC ..... *G03G 15/0891* (2013.01); *G03G 15/087* (2013.01); *G03G 15/0868* (2013.01)

(58) Field of Classification Search
CPC ..... G03G 15/087; G03G 15/0868; G03G 15/0891
See application file for complete search history.

(56) References Cited

U.S. PATENT DOCUMENTS

2011/0311261 A1 12/2011 Yamashita et al.
2012/0046142 A1* 2/2012 Miyawaki ..... G03G 15/757 475/331

FOREIGN PATENT DOCUMENTS

CN 1619432 A 5/2005
CN 102375361 A 3/2012
(Continued)

OTHER PUBLICATIONS

CN_204903948_U_T MachineTranslation, China, Wenyi, Dec. 2015.*
(Continued)

*Primary Examiner* — Victor Verbitsky
(74) *Attorney, Agent, or Firm* — Anova Law Group, PLLC

(57) ABSTRACT

A toner discharging structure and a toner cartridge are provided. The toner discharging structure cooperatively couples with a cartridge body to form a toner cartridge used in an electronic imaging device. The toner discharging structure includes: an accelerating structure, blowing blades, a toner mixing unit, and a toner discharging unit. One end of the accelerating structure is connected to the cartridge body. The blowing blades are connected to another end of the accelerating structure to allow a rotation speed of the blowing blades greater than a rotation speed of the cartridge body. The toner mixing unit is connected to the cartridge body, for receiving wind generated by the blowing blades. The toner discharging unit includes a toner outlet connected to the toner mixing unit.

19 Claims, 32 Drawing Sheets

(30) Foreign Application Priority Data

| | | |
|---|---|---|
| Dec. 29, 2018 | (CN) | 201822270227.4 |
| Feb. 18, 2019 | (CN) | 201920208270.X |
| Apr. 3, 2019 | (CN) | 201920451194.5 |
| Jul. 17, 2019 | (CN) | 201921137245.3 |

(56) References Cited

FOREIGN PATENT DOCUMENTS

| | | | | |
|---|---|---|---|---|
| CN | 204903948 | U | | 12/2015 |
| CN | 206209295 | U | | 5/2017 |
| CN | 207895230 | U | * | 9/2018 |
| JP | 2011022608 | A | * | 2/2011 |
| JP | 2015087582 | A | | 5/2015 |

OTHER PUBLICATIONS

CN_207895230_U_T MachineTranslation, China, Chen, 2018.*
JP_2011022608_A_T MachineTranslation, Japan, Hiroshi, 2011.*
The World Intellectual Property Organization (WIPO) International Search Report for PCT/CN2019/102159 dated Nov. 7, 2019 6 Pages (including translation).

* cited by examiner

TONER DISCHARGING STRUCTURE AND TONER CARTRIDGE

CROSS-REFERENCE TO RELATED APPLICATIONS

This application is a continuation application of PCT Patent Application No. PCT/CN2019/102159, filed on Aug. 23, 2019, which claims the priority of Chinese Patent Application No. 201821572861.7, filed on Sep. 26, 2018, Chinese Patent Application No. 201822045022.6, filed on Dec. 6, 2018, Chinese Patent Application No. 201822270227.4, filed on Dec. 29, 2018, Chinese Patent Application No. 201920208270.X, filed on Feb. 18, 2019, Chinese Patent Application No. 201920451194.5, filed on Apr. 3, 2019, Chinese Patent Application No. 201921137245.3, filed on Jul. 17, 2019, the contents of which are incorporated herein by reference in their entirety.

TECHNICAL FIELD

The present disclosure generally relates to the field of printing technologies and, more particularly, relates to a toner cartridge and a toner discharging structure.

BACKGROUND

A toner cartridge is widely used in the field of electronic imaging and often uses replaceable consumable materials. For example, the toner cartridge may be configured in an electronic imaging device to provide a developer to the electronic imaging device for forming an image on a recording material by an electrophotographic imaging processing technique. Such electronic imaging device includes an electrophotographic copier, a laser printer, an electrophotographic printer, a facsimile machine, and a word processor.

An existing toner cartridge mainly includes a cartridge body and a toner discharging structure. The cartridge body is filled with a large amount of developer. The cartridge body is generally a columnar structure. A toner discharging structure is generally provided at one end of the cartridge body of the toner cartridge in a length direction. The electronic imaging device drives at least a part of the toner cartridge to rotate, so that the developer can be discharged from the toner discharging structure.

FIG. 1*a* and FIG. 1*b* show an exploded view and a cross-section view of an existing toner cartridge that can be detachably mounted on a developer replenishing device. The cross-section plane is a plane passing through a rotation axis of a cartridge body of the toner cartridge. As illustrated in FIG. 1*a* and FIG. 1*b*, the toner cartridge 900 includes a cartridge body 910 for containing developer, a stirring member 920, a toner mixing unit 930, a toner outlet 931, a pump unit 940, a driving gear 911, and a driving conversion unit 950. The developer in the cartridge body 910 is transferred to the toner mixing unit 930. The toner outlet 931 is located at a bottom of the toner mixing unit 930 and allows the developer supplied by the stirring member 920 to be discharged. The pump unit 940 has a volume that changes with reciprocating movement. The driving gear 911 receives a rotational force from the developer replenishing device that rotates the cartridge body 910, and the driving conversion unit 950 converts the rotational force received by the driving gear 911 into a force that causes the pump unit 940 to operate. When the toner cartridge works in the electronic imaging device, the driving gear 911 drives the cartridge body 910 to rotate relative to the toner mixing unit 930 and a frame.

The pump unit 940 is retractable and its expansion and contraction are sufficient to change the internal pressure of the toner cartridge 900 by utilizing the volume change. The driving conversion part 950 drives the pump part 940 to perform an axial telescopic action, and drives the pressure in the toner cartridge 900 to change back and forth between positive and negative pressure. Under the action of the positive pressure of the pump unit 940, the developer flows out from the toner outlet 931 and enters a developing unit.

When the pump unit 940 returns to its original state, negative pressure drives the developer inside the toner cartridge 900 to keep the internal developer fluffy for avoiding agglomeration. When the pump unit 940 returns to its original state, there is negative pressure to suck the developer back causing that the developer is not supplied smoothly. Besides, after multiple operations of the pump unit 940's reciprocating movement, the scalability of the pump unit 940 will be reduced, resulting in a non-uniform developer supply.

Further, as shown in FIG. 1*c*, FIG. 1*d*, and FIG. 1*e*, in a working process of a toner outlet in an existing toner discharge structure, the toner outlet of the toner discharging structure is provided with two components including a fixed toner outlet plate 110 and a movable toner outlet plate 120. The fixed toner outlet plate 110 is fixed on the toner discharging structure, and the movable toner outlet plate 120 can move relative to the fixed toner outlet plate 110. A toner outlet hole 121 is disposed on the movable toner outlet plate 120, and a toner outlet 111 is provided on the fixed toner outlet plate 110. Before the toner cartridge is installed on the electronic imaging device, as shown in FIG. 1*d*, the toner outlet hole 121 and the toner outlet 111 do not overlap, and the developer cannot flow out of the toner outlet hole 121. After the toner cartridge is installed on the electronic imaging device, as shown in FIG. 1*e*, a hook 122 interferes with the electronic imaging device, so that the movable toner outlet plate 120 moves relative to the fixed toner outlet plate 110, and the toner outlet hole 121 and the toner outlet 111 Overlap. Correspondingly the developer can flow out. The movable toner outlet plate 120 is also connected to the fixed toner outlet plate or tonner dispenser through an elastic member, so that when the toner cartridge is removed from the electronic imaging device, the toner outlet hole 121 and the toner outlet port 111 are no longer recombined and returned to a state in FIG. 1*d*. Then the developer cannot flow out.

SUMMARY

The present disclosure provides a toner discharge structure and a toner cartridge, to allow the developer to enter an electronic imaging device through a toner outlet.

One aspect of the present disclosure provides a toner discharging structure. The toner discharging structure cooperates with a cartridge body to form a toner cartridge used in an electronic imaging device. A cartridge body of the toner cartridge receives rotation driving force from the electronic imaging device. The toner discharging structure includes: an accelerating structure, blowing blades, a toner mixing unit, and a toner discharging unit. One end of the accelerating structure is connected to the cartridge body. The blowing blades are connected to another end of the accelerating structure to make a rotation speed of the blowing blades greater than a rotation speed of the cartridge body.

The toner mixing unit is connected to the cartridge body, for receiving wind generated by the blowing blades. The toner discharging unit includes a toner outlet connected to the toner mixing unit.

Another aspect of the present disclosure provides a toner cartridge. The toner cartridge includes a cartridge body and a toner discharging structure. The toner discharging structure includes: an accelerating structure, blowing blades, a toner mixing unit, and a toner discharging unit. One end of the accelerating structure is connected to the cartridge body. The blowing blades are connected to another end of the accelerating structure to make a rotation speed of the blowing blades greater than a rotation speed of the cartridge body. The toner mixing unit is connected to the cartridge body, for receiving wind generated by the blowing blades. The toner discharging unit includes a toner outlet connected to the toner mixing unit.

In the present disclosure, an accelerating structure may be provided with the toner discharging structure. The accelerating structure may accelerate the toner cartridge with a low rotating speed to drive blades of a blower to rotate with high speed with respect to the toner cartridge. Correspondingly, wind may be generated to blow air and the developer out through the toner outlet.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1A:
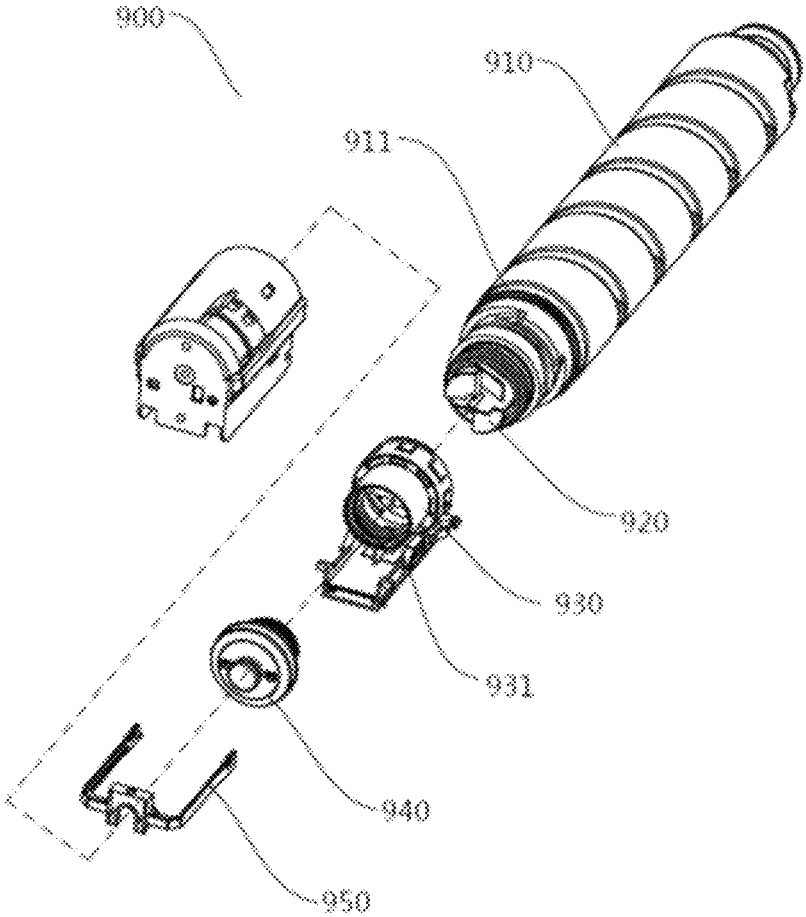
FIG. 1*a* illustrates an exploded view of an exemplary toner cartridge in existing technologies.
Figure 1B:
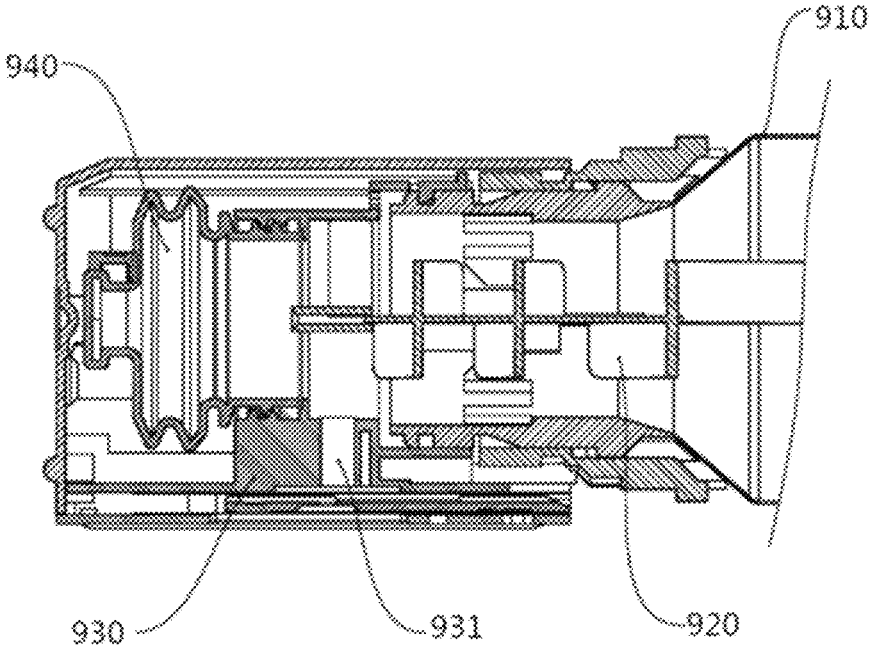
FIG. 1*b* illustrates a cross-section view of an exemplary toner cartridge in existing technologies.
Figure 1C:
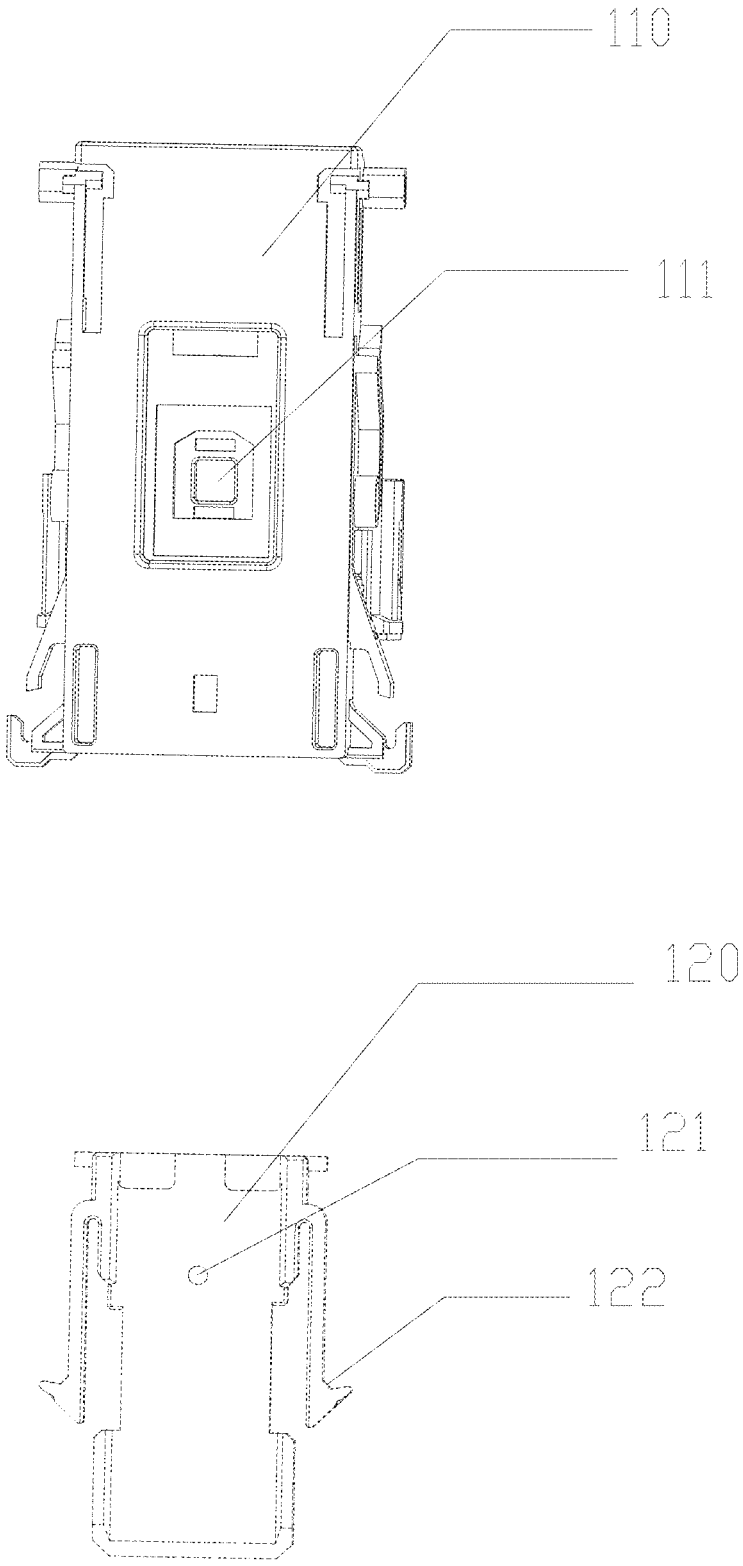
FIG. 1*c* illustrates a structure of a fixed toner outlet plate and a movable toner outlet plate.
Figure 1D:
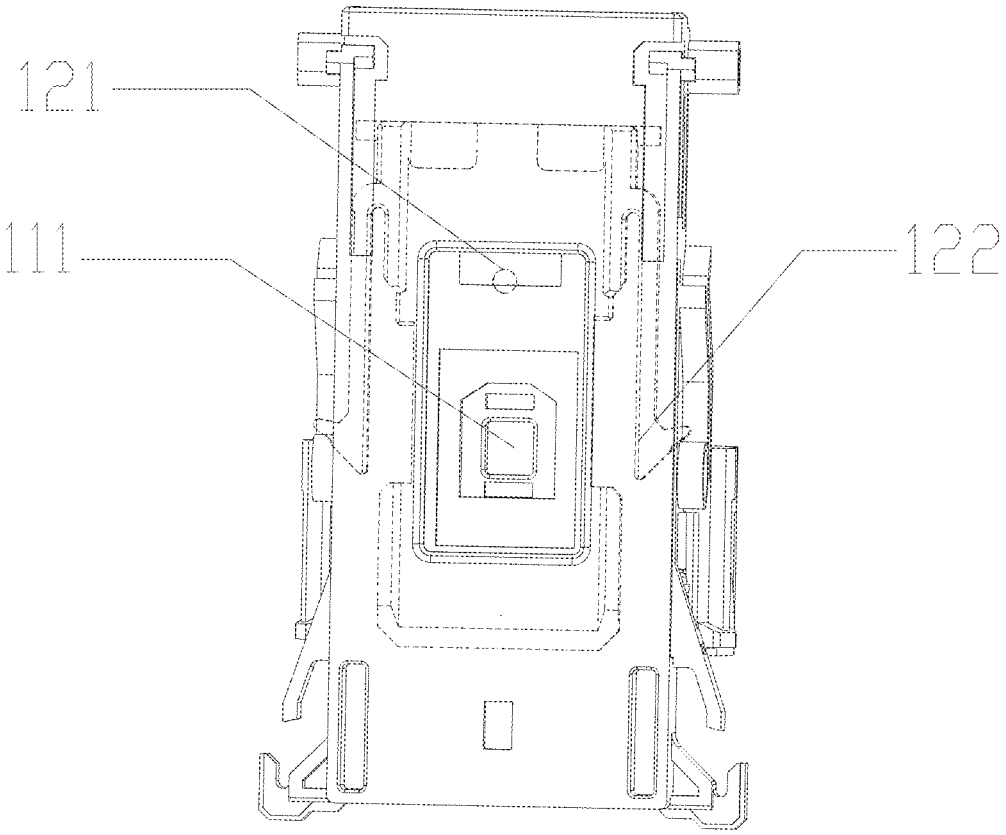
FIG. 1*d* illustrates a structure of a fixed toner outlet plate and a movable toner outlet plate when the toner cartridge does not discharge toner.
Figure 1E:
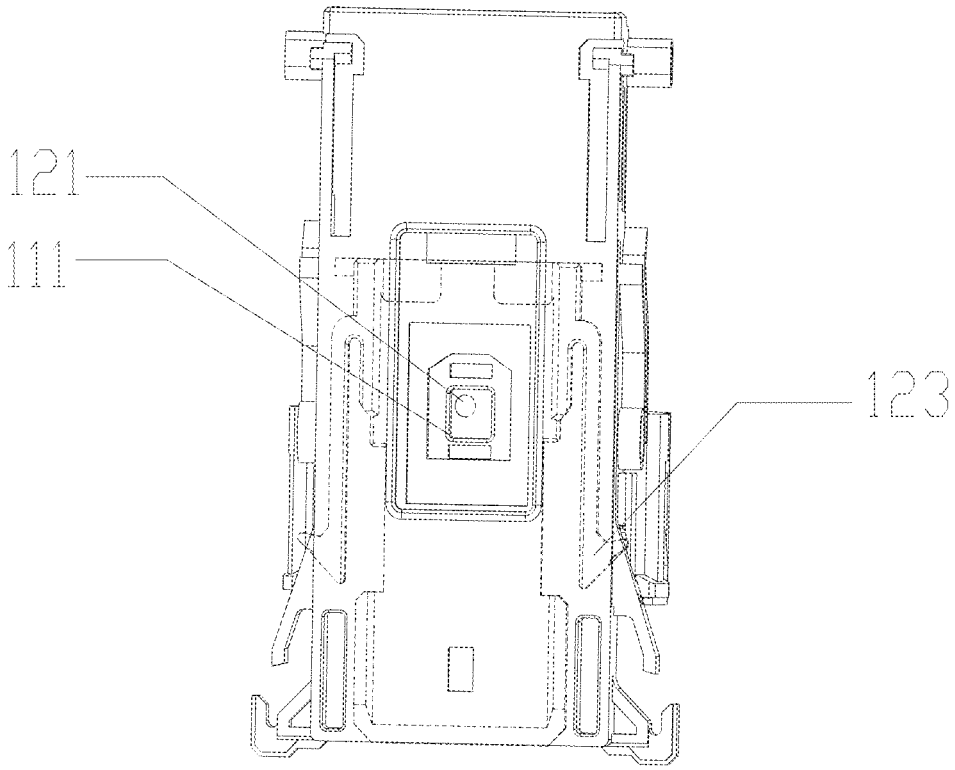
FIG. 1*e* illustrates a structure of a fixed toner outlet plate and a movable toner outlet plate when the toner cartridge discharges toner.

Reference will now be made in detail to exemplary embodiments of the disclosure, which are illustrated in the accompanying drawings. Hereinafter, embodiments consistent with the disclosure will be described with reference to drawings. In the drawings, the shape and size may be exaggerated, distorted, or simplified for clarity. Wherever possible, the same reference numbers will be used throughout the drawings to refer to the same or like parts, and a detailed description thereof may be omitted.

Further, in the present disclosure, the disclosed embodiments and the features of the disclosed embodiments may be combined under conditions without conflicts. It is apparent that the described embodiments are some but not all of the embodiments of the present disclosure. Based on the disclosed embodiments, persons of ordinary skill in the art may derive other embodiments consistent with the present disclosure, all of which are within the scope of the present disclosure.

Moreover, the present disclosure is described with reference to schematic diagrams. For the convenience of descriptions of the embodiments, the cross-sectional views illustrating the device structures may not follow the common proportion and may be partially exaggerated. Besides, those schematic diagrams are merely examples, and not intended to limit the scope of the disclosure. Furthermore, a three-dimension. (3D) size including length, width and depth should be considered during practical fabrication.

As illustrated in the background, toner can be discharged only when the toner outlet hole 121 and the toner outlet 111 are overlapped. A size of the toner outlet hole 121 and an opening for receiving the developer on the electronic imaging device is small. Therefore, an air blowing device is required to blow the developer into the electronic imaging device through the toner outlet hole 121, or the developer is pushed through the toner outlet hole 121 by using a pushing device. The present disclosure provides a blower. The blower may blow the developer from the inside of the toner cartridge through the toner outlet hole 121. The specific content will be described in detail through the following embodiments.

An embodiment of the present disclosure provides an accelerating structure. The accelerating structure may accelerate the toner cartridge with a low rotating speed to drive blades of a blower to rotate with a high speed with respect to the toner cartridge. Correspondingly, wind may be generated to blow air and the developer out through the toner outlet hole.

Figure 2:
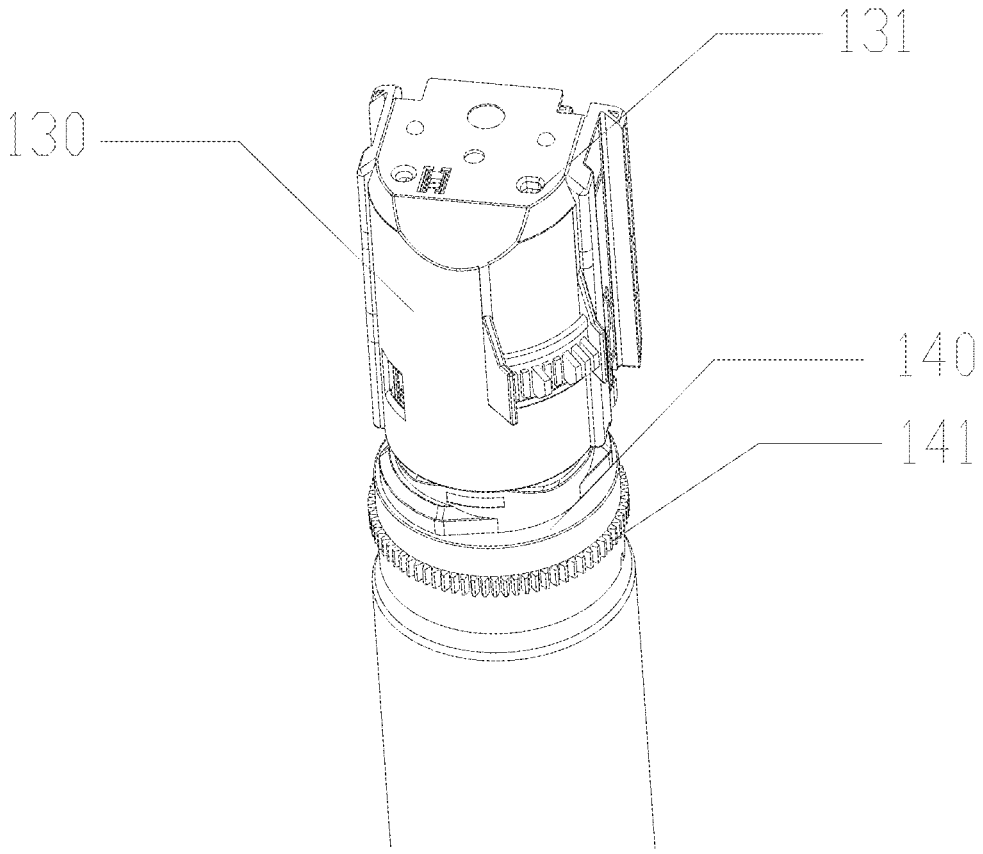
FIGS. 2-3 illustrate a three-dimensional structure of an exemplary toner discharging structure.
Figure 3:
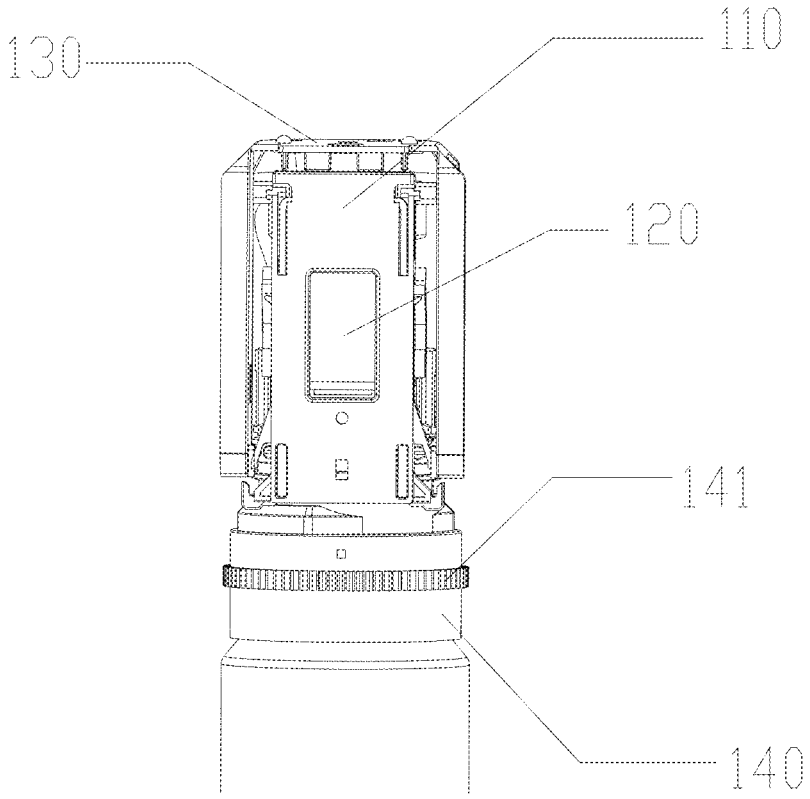

The present embodiment provides a toner cartridge and a toner discharging structure. As illustrated in FIGS. 2-3, one end of the toner cartridge may be provided with a toner discharging structure. The toner discharging structure may include a connection unit 140 connected to the toner cartridge, and the connection unit 140 may include a ring gear 141. The ring gear 141 may be capable of being engaged with the electronic imaging device to obtain a rotational driving force from the electronic imaging device. The toner discharging structure may further include a frame 130 and one side of the frame 130 may be connected to a fixed toner outlet plate 110. In one embodiment, preferably, the frame 130 may have a structure similar to a partially cylindrical structure, and the fixed toner outlet plate 110 may be disposed at one end of the partially cylindrical structure of the frame 130 in a direction parallel to a rotational axis of the cartridge body of the toner cartridge (that is, a direction parallel to a length direction of the toner cartridge), to make a side surface structure of the partially cylindrical structure closed. The combined structure may also be regarded as that the fixed toner outlet plate 110 cuts a virtual cylinder where the frame 130 is located and two ends of the fixed toner outlet plate 110 is connected to the side of the virtual cylinder.

When the toner cartridge is installed in the electronic imaging device for normal work, the combined structure of the frame 130 and the fixed toner outlet plate 110 may be fixed inside the electronic imaging device, and the combined structure of the connecting unit 140 and the cartridge body of the toner cartridge may rotate along the rotation axis of the cartridge body of the toner cartridge, that is, the combined structure of the connecting unit 140 and the cartridge body of the toner cartridge may rotate relative to the combined structure of the frame 130 and the fixed toner outlet plate 110 when the toner cartridge is in operation. Among them, the fixed toner outlet plate 110 may be disposed at a position lower in the direction of gravity after the toner cartridge is installed in the electronic imaging device, and the frame 130 may be disposed at a position higher in the direction of gravity. Correspondingly, the developer can automatically reach the vicinity of the toner outlet plate 110 under the effect of gravity, and may not accumulate inside the frame 130.

An air inlet 131 may be further disposed at the frame 130 for providing required gases to a blower. In one embodiment, preferably, the air inlet 131 may be disposed at a top surface of the partially cylindrical structure formed by the frame 130 and the fixed toner outlet plate 110. That is, the air inlet 131 may be disposed at a surface where the toner discharging structure is farthest from the cartridge body of the toner cartridge.

Figure 4:
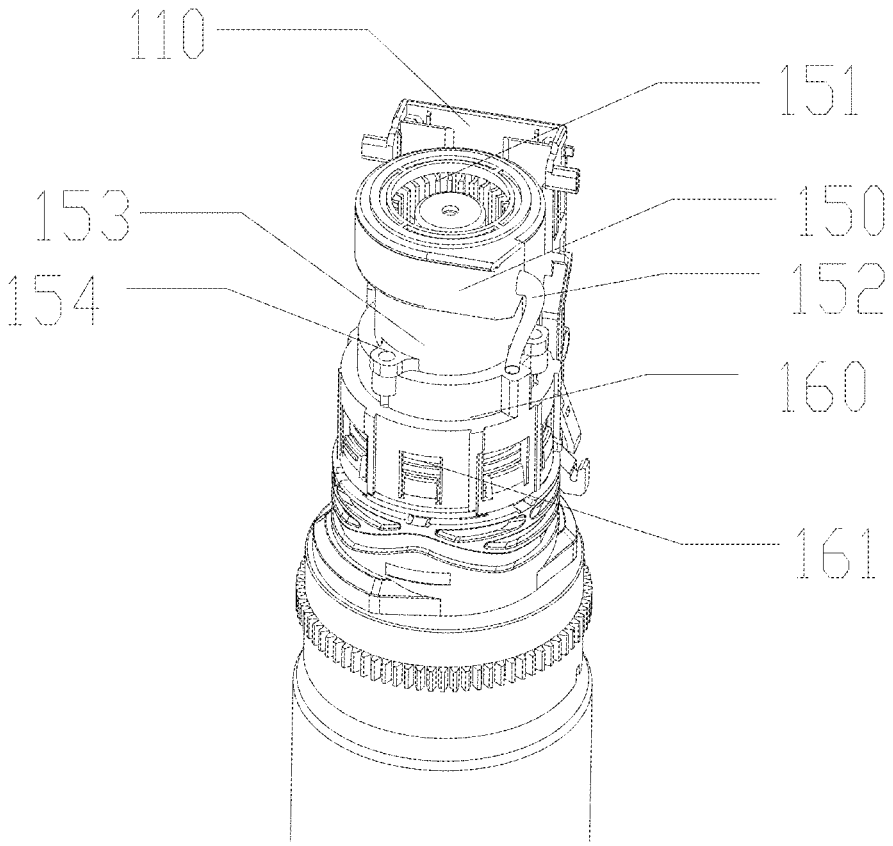
FIG. 4 illustrates a three-dimensional structure of an exemplary toner discharging structure after removing a cover consistent with various embodiments of the present disclosure.

As illustrated in FIG. 4 showing a schematic structural diagram of the toner cartridge after the frame 130 is removed, the toner discharging structure may further include a mechanical blowing component 150. The mechanical blowing component 150 may include a blowing blade 151. Preferably, the blowing blade 151 may be a centrifugal blowing blade. When the blowing blade 151 rotating, wind may enter from an axial upper part of the blowing blade 151 and may be blown out from a radial side of the blowing blade 151. In this embodiment, the wind may enter the inside of the blowing blade 151 along the rotation axis of the blowing blade 151 from the side away from the cartridge body of the toner cartridge through the air inlet 131, and then may be blown out after the blowing blade 151 rotates. That is, the blowing blade 151 may be considered as a cylinder, and the wind may be sucked in from a side of the imaginary cylinder away from the cartridge body of the toner cartridge and may be blown out from a side surface of the imaginary cylinder. The wind that is blown out from the blowing blade 151 may enter an air duct 152, and then enter a toner mixing unit 160. In the toner mixing unit 160, the wind then may blow the developer out from the toner outlet 111 and the toner outlet hole 121 of the fixed toner plate 110 and the movable toner plate 120. The developer may flow into the electronic imaging device. The toner mixing unit 160 may be connected to the fixed toner outlet plate 110. When the toner cartridge is located inside the electronic imaging device and works, the toner mixing unit 160 may not rotate. Preferably, a check valve may be disposed in the middle of the air duct 152. Correspondingly, the air may only be blown from the mechanical blowing component 150 to the toner mixing unit 160, and the developer-containing air or the developer in the toner mixing unit 160 will not flow back to the blowing blade 150 to interfere with a normal operation of the blowing blade 151. In another embodiment, the check valve may be a cross silicon valve or any other suitable valve.

The mechanical blowing component 150 may further include a plurality of sets of planetary gears, to accelerate the rotation speed of the ring gear 141 driven by the electronic imaging device and to provide force to the blowing blade 151. In one embodiment, preferably, the plurality of sets of planetary gears may include an outer ring gear 153, and the outer ring gear 153 may be connected to the toner mixing unit 160. Preferably, the outer ring gear 153 may be connected to the toner mixing unit 160 by driving a screw into a screw hole 154. When the toner cartridge works inside the electronic imaging device, the outer ring gear 153 may not rotate.

Figure 5:
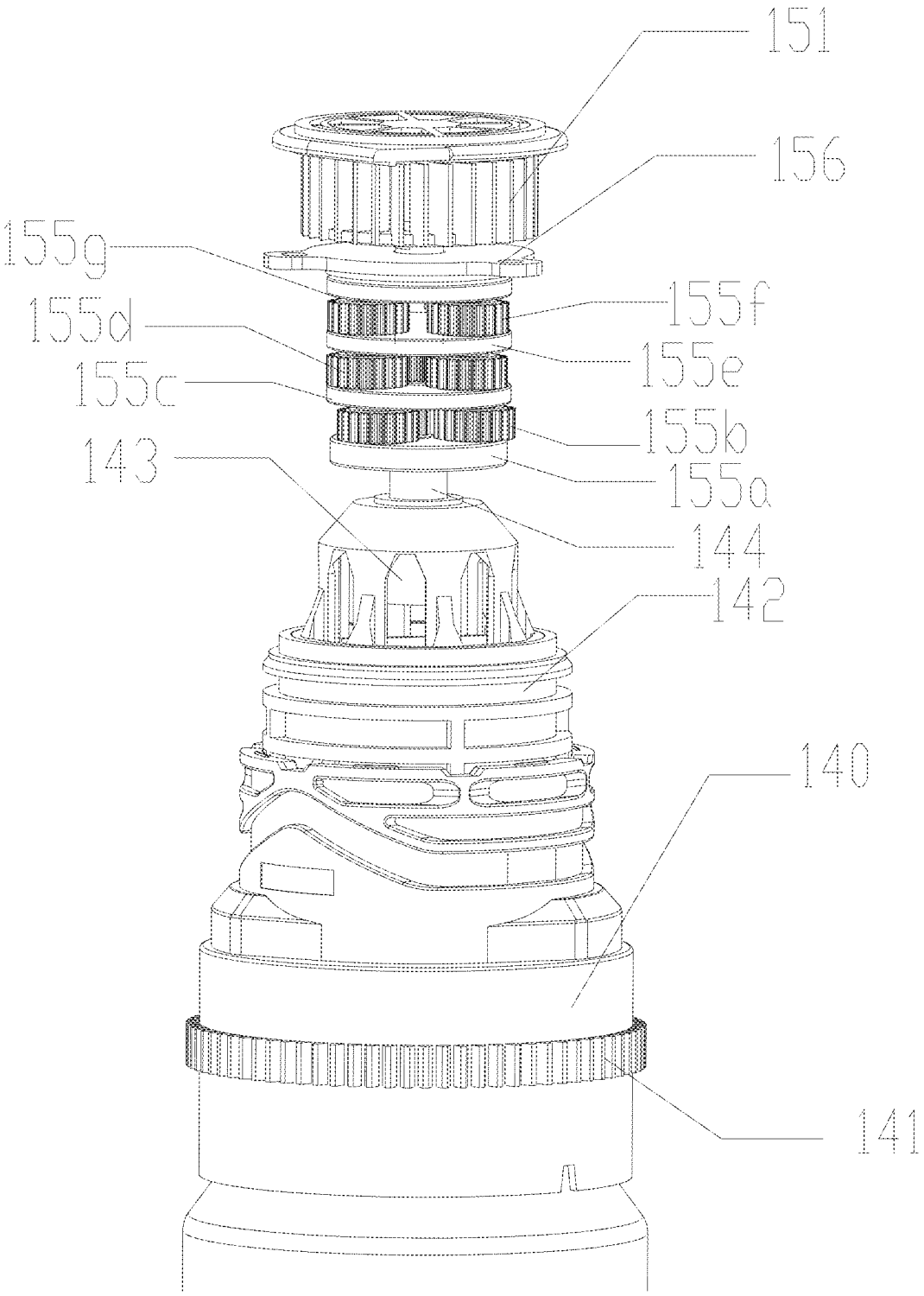
FIG. 5 illustrates a three-dimensional structure of an exemplary toner discharging structure after removing the cover, the toner mixing unit, and the outer ring gear, consistent with various embodiments of the present disclosure.

FIG. 5 is a schematic diagram of the structure after further removing the toner mixing unit 160 and the outer ring gear 153 in FIG. 4. FIG. 5 illustrates a preferred planetary gear layout structure and the connecting unit 140 for the planetary gear acceleration group, a manner in which the developer enters the toner mixing unit 160 from the connection unit 140, a connecting relationship between the connection unit 140 and the toner mixing unit 160, and a movement relationship during operation. After the connecting unit 140 obtains the rotational driving force from the electronic imaging device through the ring gear 141, the cartridge body of the toner cartridge and the connecting unit 140 may rotate along a rotation axis of the cartridge body of the toner cartridge parallel to the length direction of the toner cartridge, and the connecting unit 140 may transmit the rotation to a first stage planet carrier 155*a* through an input shaft 144. Because the outer ring gear 153 is fixed, a first stage sun gear (that is, a second stage planet carrier) 155*c* may obtain a rotation speed higher than the input shaft 144 and the first stage planet carrier 155*a* by the acceleration of a first stage planetary pinion 155*b*. The first stage sun gear (the second stage planet carrier) 155*c* may have one end as the first stage sun gear and another end as the second stage planet carrier. By the acceleration of a second stage planetary pinion 155*d*, a second stage sun gear (that is, the third stage planetary carrier) 155*e* may obtain a rotation speed higher than the first stage sun gear (the second stage planet carrier) 155*c*. Similarly, a third-stage sun gear 155*g* may obtain a rotation speed higher than the second-stage sun gear (the third-stage planet carrier) 155*e* by the acceleration of a third-stage planetary pinion 155*f*. Another end of the third-stage sun gear 155*g* may be directly connected to the blowing blade 151 and provide a rotational driving force for the blowing blade 151. The planetary gear structure may further include an upper baffle 156 connected to the outer ring gear 153. On the one hand, each component of the planetary gear structure may be restrained inside the outer ring gear 153 to prevent parts from being lost. On another hand, the blowing blade 151 and the planetary gear structure may be also separated to prevent mutual interference. Through the multi-stage acceleration, the blowing blades can obtain a sufficient rotation speed and generate enough wind to blow the developer from the toner cartridge into the electronic imaging device. Of course, the planetary gear accelerator in this application may have other suitable deformation methods, such as using a fixed sun gear, using a planet carrier input, an external ring gear output, or planet gears designed in different stages, but all belong to the use of planetary gear acceleration to convert a smaller rotation speed from the electronic imaging device to a greater rotation speed for driving the blowing blades, and should be included in the scope of the present disclosure.

The connection unit 140 may include a developer outlet 143, and the developer outlet 143 may be enclosed inside the toner mixing unit 160. The developer may enter the toner mixing unit 160 through the developer outlet 143. The wind may enter the toner mixing unit 160 through the air duct 152 after being blown out from the blowing blade 151. Because of effects of the stirring member and the gravity inside the toner cartridge, the developer at the toner outlet 111 of the fixed toner outlet plate 110 may be blown out and enter the electronic imaging device.

Figure 6:
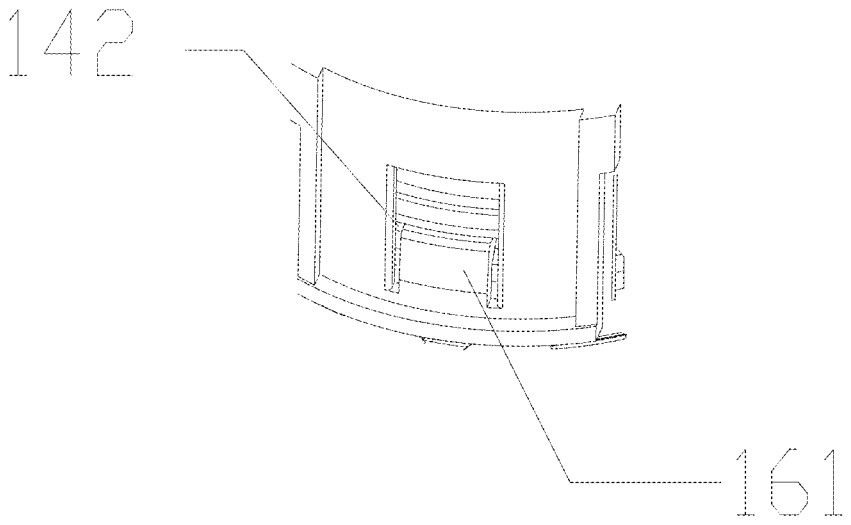
FIG. 6 illustrates a connection method between the toner mixing unit and the connection component consistent with various embodiments of the present disclosure.

FIG. 6 illustrates a connecting structure between the connection unit 140 and the toner mixing unit 160. When the toner cartridge works inside the electronic imaging device, the toner mixing unit 160 may be fixed with respect to the electronic imaging device, and the connection unit 140 may rotate. Correspondingly, a connecting between the connection unit 140 and the toner mixing unit 160 may move with respect to each other. As illustrated in FIG. 5, the connection unit 140 may include a groove 142. The groove 142 may have a ring shape and a center of the ring of the groove 142 may pass through the rotation axis of the cartridge body of the toner cartridge. As illustrated in FIG. 6, the toner mixing unit 160 may include buckles 161. The buckles 161 may include protrusions that enter the groove 142. As illustrated in FIG. 4, the toner mixing unit 160 may include a plurality of buckles 161 that surrounding the groove 142 in a ring shape. Therefore, the connection unit 140 may rotate relative to the toner mixing unit 160 and may not escape.

At the same time, to ensure the blowing effect, seals may be provided when the above components are connected, especially a rubber ring or a foamed cotton may be provided between the connection unit and the toner mixing unit, to minimize the leakage of wind from other parts. Correspondingly the wind generated by the blowing blade 151 may be used to push the developer out from the toner cartridge to a greater extent.

In this embodiment, the planetary gear accelerator is provided to increase the lower rotation speed of the toner cartridge to a higher rotation speed for driving the blowing blade 151. Correspondingly, the developer can be blown out of the toner cartridge.

Another embodiment of the present disclosure provides another toner cartridge and toner discharging structure. Different from the mechanical blowing component 150 in the previous embodiment, an electrical blowing component 250 may be introduced in the present embodiment to substitute the mechanical blowing component 150.

Figure 7:
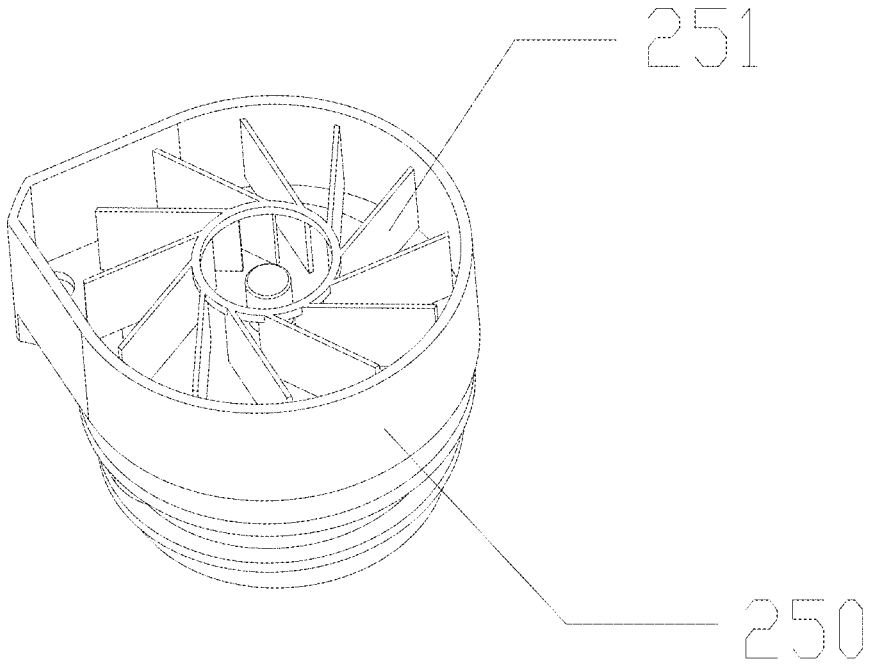
FIGS. 7-8 illustrate a three-dimensional structure of an electrical blowing component consistent with various embodiments of the present disclosure.

As illustrated in FIG. 7, the electrical blowing component 250 may include a blowing blade 251. The blowing blade 251 may have a structure similar as the blowing blade 151 in the previous embodiment.

Figure 8:
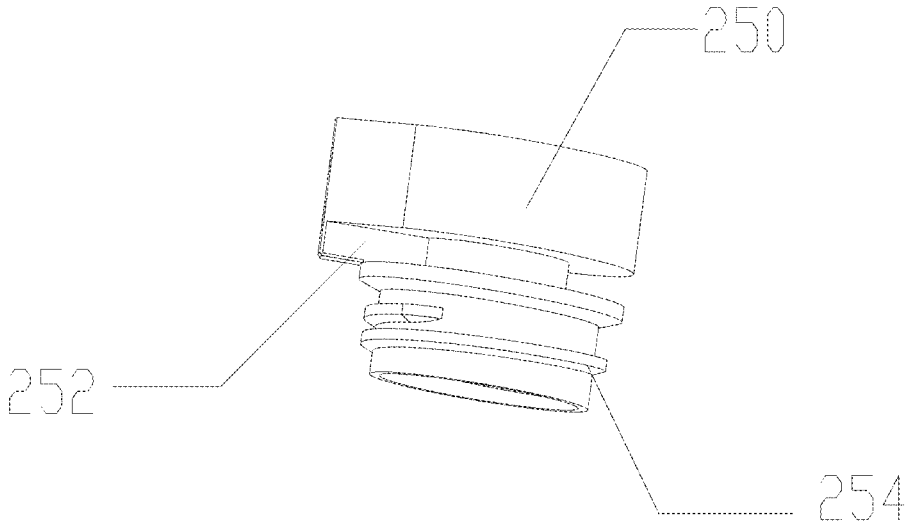

As illustrated in FIG. 8, the electrical blowing component 250 may further include an air duct 252. The air duct 252 may have a structure different from the air duct 152 in the previous embodiment, but may have an operation principle similar. The air duct 252 may transmit wind generated by the blowing blade 251 to the toner mixing unit 160. In one embodiment, preferably, a check valve or a cross silicon valve described in the previous embodiment may be disposed in the air duct 252.

Figure 9:
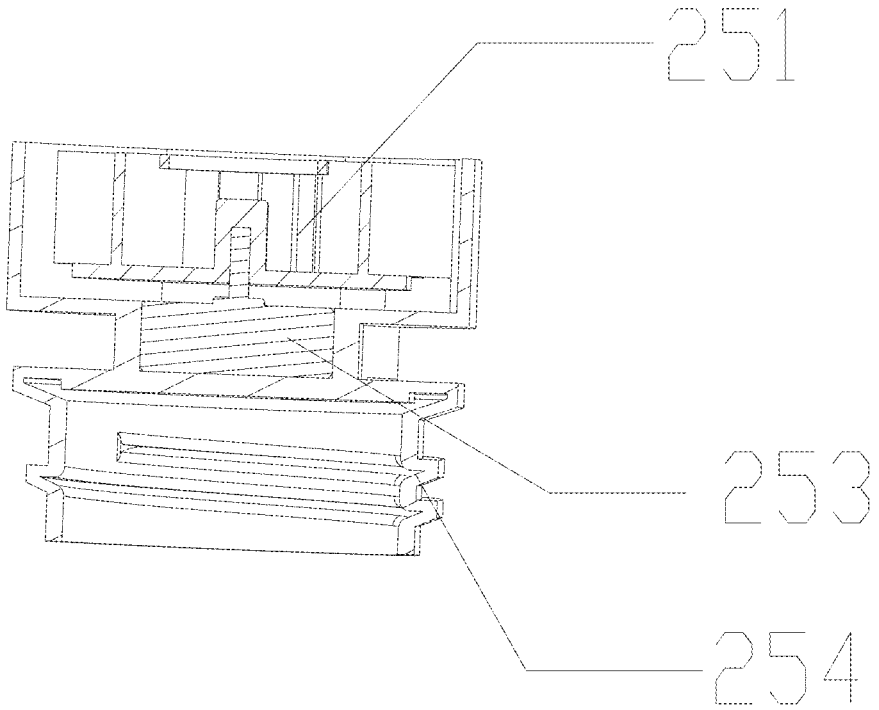
FIG. 9 illustrates a cross-section view of an electrical blowing component along a plane including the rotation axis of the toner cartridge, consistent with various embodiments of the present disclosure.

FIG. 9 illustrates a cross-sectional view of the electrical blowing component 250 along a plane passing the rotation axis of the toner cartridge. A motor component 253 may be further disposed inside the electrical blowing component 250, for providing rotation driving force to the blowing blade 251. The motor component 253 may include a DC brushless motor and a battery pack for supplying force to the DC brushless motor. In some other embodiment, the battery pack and the motor may be disposed separately at other positions of the toner cartridge. The core of this embodiment is to convert electrical energy into mechanical energy, for driving the blowing blades 251 to generate wind energy and push the developer to enter the electronic imaging device from the toner cartridge.

Figure 10:
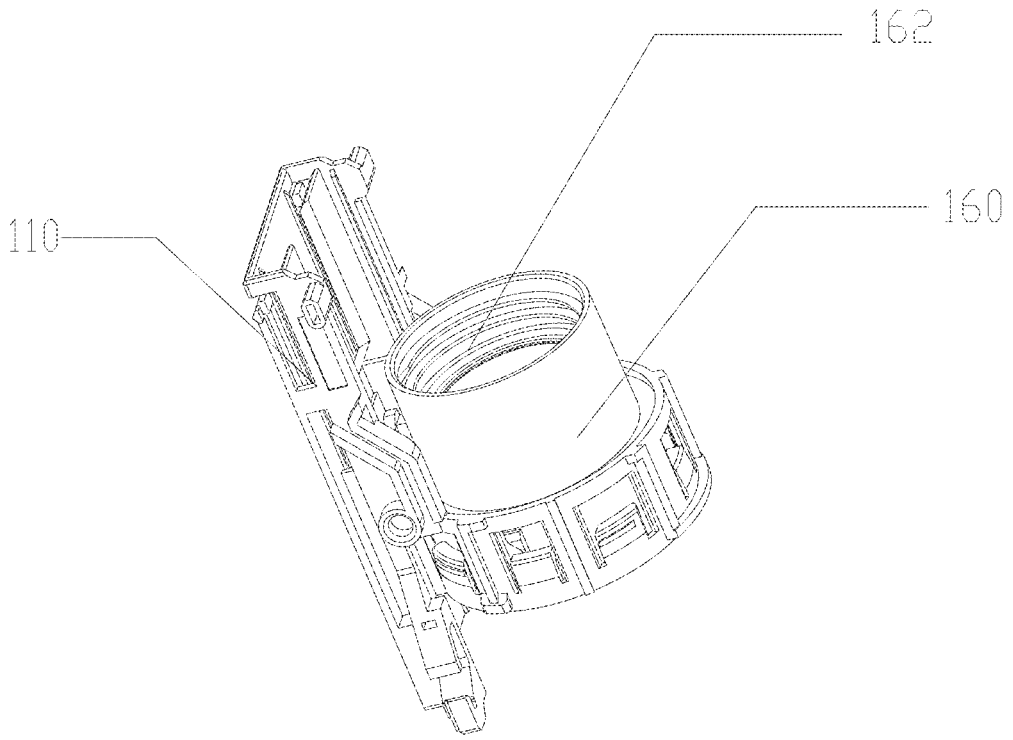
FIG. 10 illustrates a three-dimensional structure of a toner mixing unit and the fixed toner outlet plate, consistent with various embodiments of the present disclosure.

FIGS. 8-9 illustrates a connecting method between the electrical blowing component 250 and the toner mixing unit 160. A thread 254 may be formed on an outer wall of the electrical blowing component 250 close to the toner mixing unit 160. Correspondingly, as illustrated in FIG. 10, an inner wall of the toner mixing unit 160 near the electric blowing component 250 may be provided with a thread 162 that can be engaged with the thread 254 on the outer wall of the electric blowing component 250 near the toner mixing unit 160. That is, the electric blowing component 250 can be screwed to the toner mixing unit 160 by thread engagement. For description purposes only, the above embodiment where the electric blowing component 250 can be screwed to the toner mixing unit 160 by thread engagement is used as an example to illustrate the present disclosure, and should not limit the scopes of the present disclosure. In various embodiments, any suitable methods including the method in the previous embodiment and other connecting methods may be used.

To facilitate storage and transportation, an insulation rod can be disposed on one pole of the battery. When the insulation rod is not pulled down, the battery does not supply force to the motor. When the user installs the toner cartridge into the electronic imaging device, the user may remove the insulation rod and the battery can force the motor.

Preferably, the motor can be further controlled. That is, when the toner cartridge rotates, the battery may supply force to the motor to rotate the motor. In one embodiment, specifically, the motor can be controlled by PLC, using a sensor to monitor whether the toner cartridge is rotating. That is, the sensor may be disposed at the contact portion of the toner mixing unit 160 and the connection unit 140. In another embodiment, the motor may be controlled by a relay. A contact part may be disposed at the connection unit 140. The contact part may conduct the circuit to make the relay continue to work ever time the connection unit 140 rotates by one turn. When the connection unit 140 does not rotate, the contact part may not conduct the circuit, and the relay may not continue to work, and the motor stops.

Figure 11:
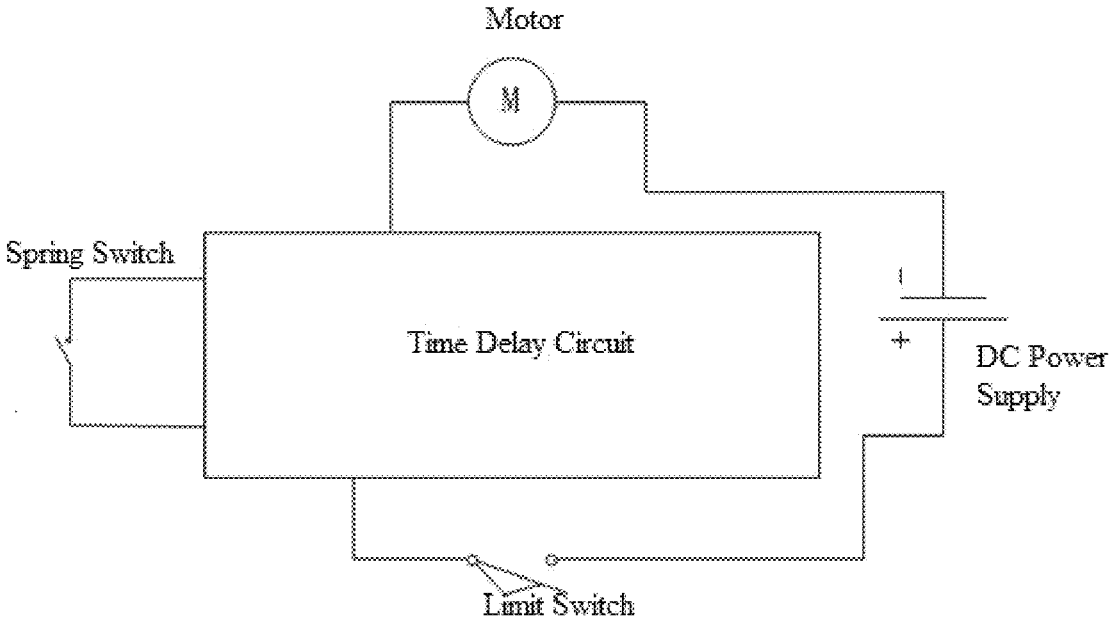
FIG. 11 illustrates a circuit diagram of a relay consistent with various embodiments of the present disclosure.

As shown in FIG. 11, a DC power supply, a power supply series limit switch, a time delay circuit module, and the motor are connected in series. The DC power supply may force the motor. When the limit switch is closed (the circuit is connected) and the time delay circuit module is conductive, the motor may obtain force from the DC power supply and rotate. Preferably, after the toner cartridge is installed in the electronic imaging device, the limit switch may be closed. One preferred solution is that the two ends of the limit switch may be respectively mounted on the fixed toner outlet plate 110 and the movable toner outlet plate 120. When the toner cartridge is installed on the electronic imaging device, the movable toner outlet plate 120 may move relative to the fixed toner outlet plate 110, and its final position (i.e., the position maintained during normal printing) may make the limit switch close. The time delay circuit module may control whether or not to exert the delay effect through a spring switch, to make the circuit open or close. Preferably this can be achieved through the relays and contact parts described above. Of course, it can also be implemented through other schemes, but all are within the scope of the present disclosure.

Another embodiment of the present disclosure provides another toner cartridge and toner discharging structure. Different from the previous embodiment, a push rod 370 may be further disposed to separate the planetary gear producing the gas and the toner mixing unit accommodating the developer. Correspondingly, the developer may be prevented from entering the planetary gear to affect the working condition and a lifetime of the gear. For description purposes only, the present embodiment only uses the planetary gear as an example to illustrate the present disclosure and should not limit the scopes of the present disclosure. In other embodiments, the structure can be also used in the toner cartridge driven electrically in the previous embodiments.

Figure 12:
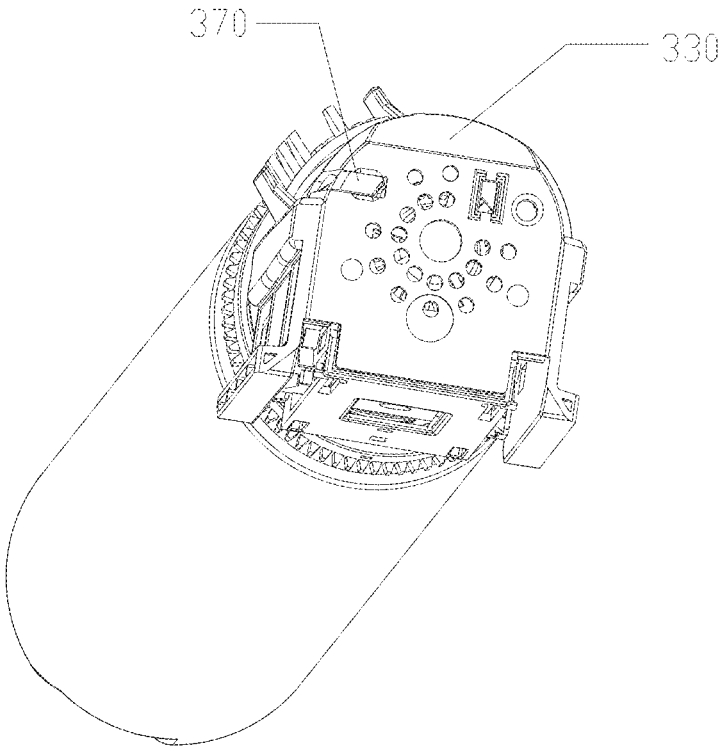
FIGS. 12-14 illustrate three-dimensional structures of a toner cartridge consistent with various embodiments of the present disclosure.
Figure 13:
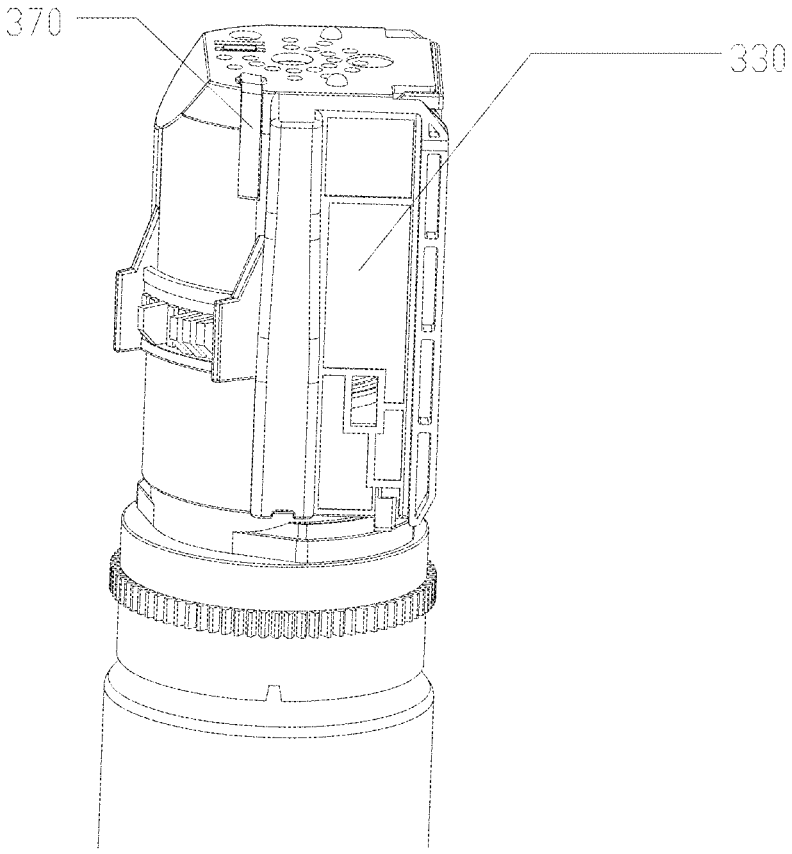
Figure 14:
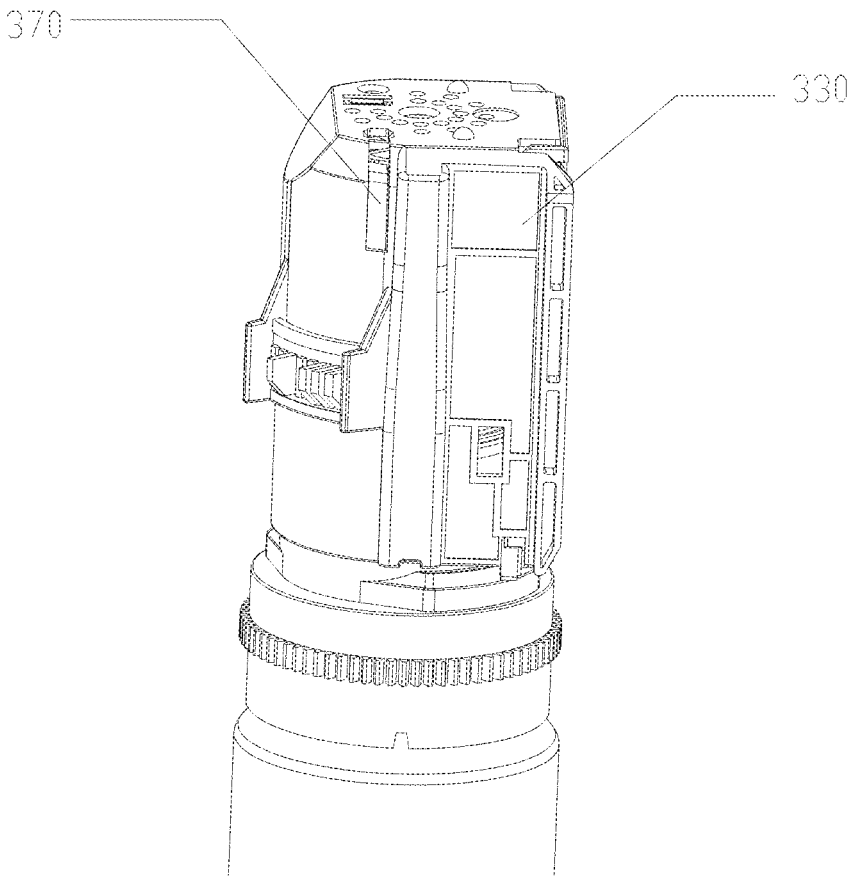

FIGS. 12-14 illustrate three-dimensional views of the toner cartridge. As illustrated in FIGS. 12-14, one end of the push rod 370 may be disposed at an outer surface of the frame 330. The push rod 370 can be extended and contracted in a direction parallel to the rotation axis of the toner cartridge. As shown in FIG. 13 where the toner cartridge is not installed at this time, the push rod 370 may be in a first position. When the toner cartridge is mounted on the electronic imaging device and works normally, the push rod 370 may be pushed by the electronic imaging device, to move in a direction parallel to the rotation axis of the toner cartridge toward the toner cartridge (that is, the push rod 370 may be contracted relative to the frame 330), as shown in FIG. 14. At this time the push rod 370 may be in a second position.

Figure 15:
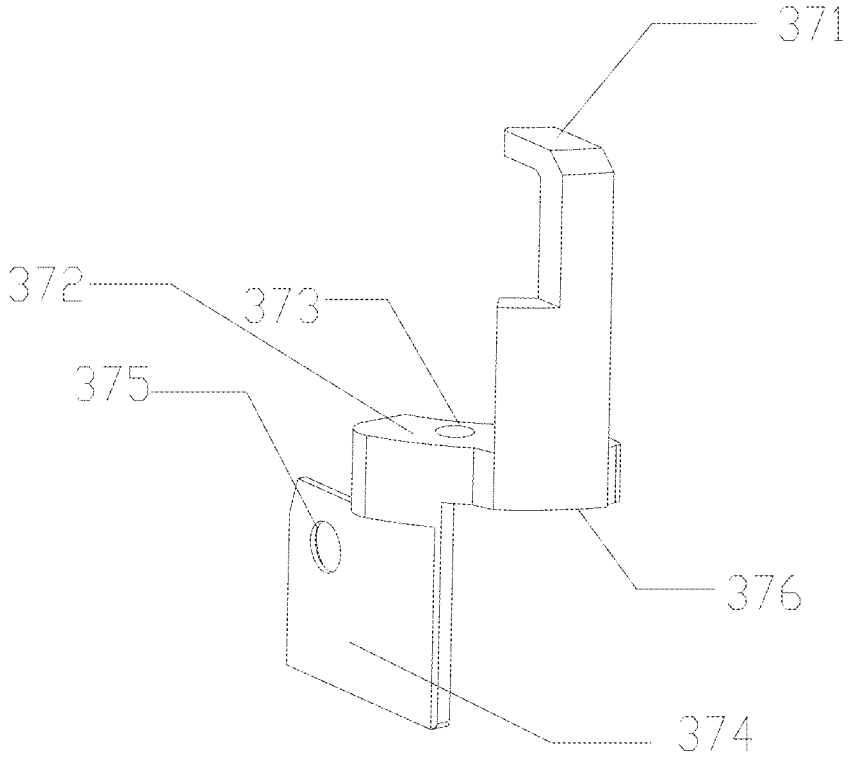
FIGS. 15-16 illustrate structures of a push rod consistent with various embodiments of the present disclosure.
Figure 16:
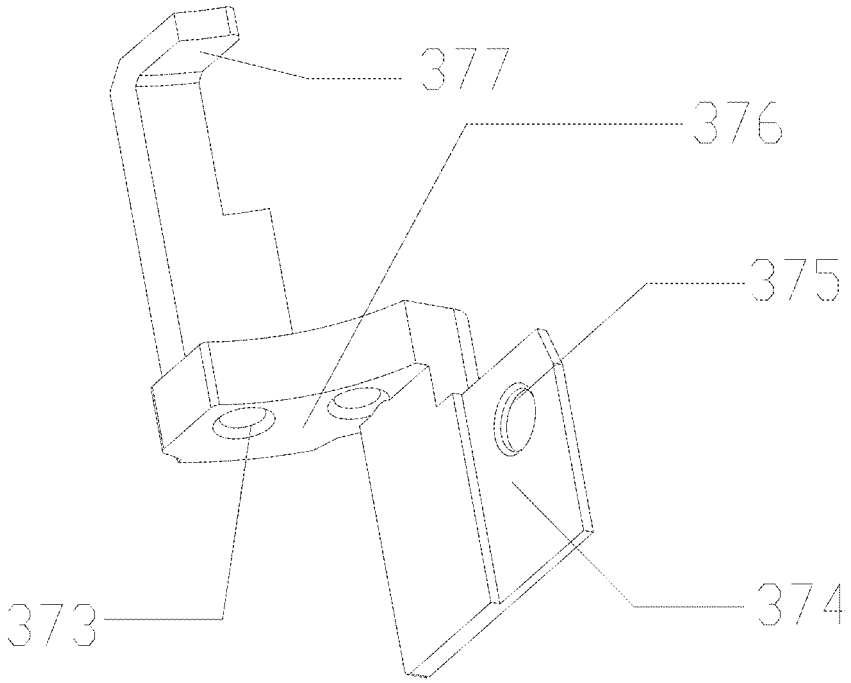

FIG. 15 and FIG. 16 illustrate the structure of the push rod 370 in this embodiment in detail. An abutting surface 371 may abut against the electronic imaging device, to push the push rod 370 to move from the first position to the second position. A first restricting surface 372, a second restricting surface 376, a third restricting surface 377, and restricting holes 373 may restrict the push rod 370, correspondingly the push rod 370 can only move in the direction parallel to the rotation axis of the toner cartridge and cannot come out. Preferably, a number of the restricting holes 373 may be two. A blocking surface 374 may be used to isolate the toner mixing unit and the planetary gear structure. A through hole 375 may be formed in the blocking surface 374.

Figure 17:
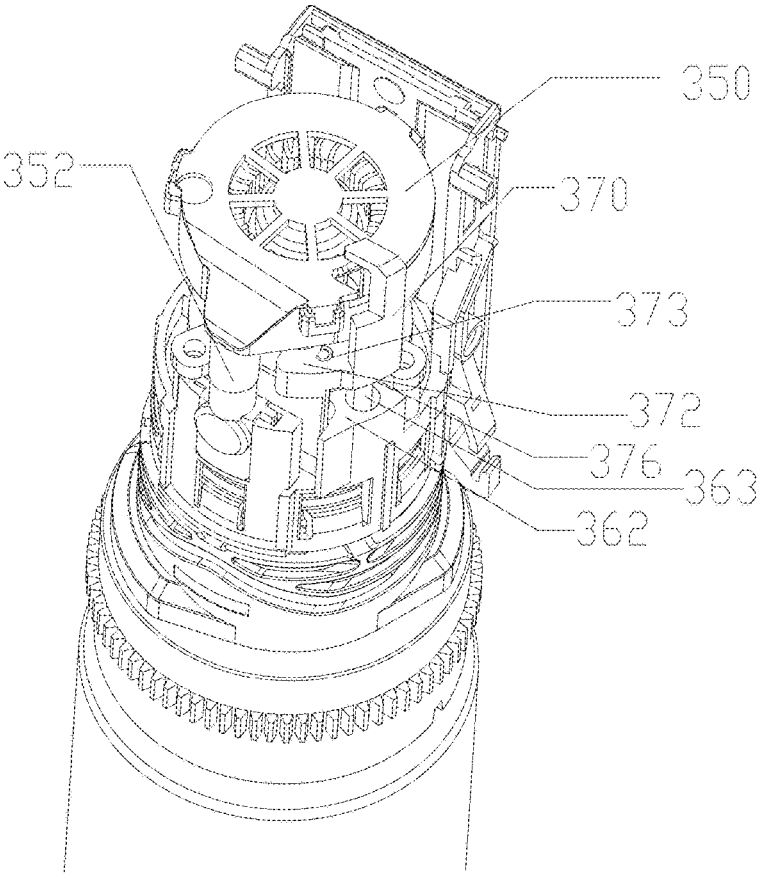
FIG. 17 illustrates a position relationship of a push rod in a toner cartridge after removing the cover, consistent with various embodiments of the present disclosure.

FIG. 17 is a positional relationship diagram of the push rod after removing the frame. As shown in FIG. 17, the outer surface of the mechanical blowing component 350 may abut against the first restricting surface 372 and the third restricting surface 377, for restricting the position of the push rod 370. The outer surface of the toner mixing unit may be provided with a support rod 363 and a fourth restricting surface 362. The support rod 363 may enter the restricting holes 373, and the fourth restricting surface 362 may abut against the second restricting surface 376, for restricting the push rod 370 to only move along the direction parallel to the rotation axis of the toner cartridge without coming out. The blocking surface 374 and the through hole 375 at one end of the air duct 352 near the toner mixing unit may be located between the air duct 352 and the toner mixing unit, and may be used to make the blocking surface 374 block the connecting between the air duct 352 and the toner mixing unit, or to make the through hole 375 connecting the air duct 352 and the toner mixing unit. An elastic member (not shown in the figure) may be further disposed between the push rod 370 and the main body of the toner discharging structure. The elastic member may make the push rod 370 tend to move away from the cartridge body of the toner cartridge. Correspondingly, when the abutting surface 371 is not pressed (for example, after the toner cartridge is removed from the electronic imaging device), the push rod 370 may return from the second position to the first position. Due to the constraints of the above components, the push rod will not come off the powder cartridge. Preferably, the elastic member may be disposed between the second restricting surface 376 and the fourth restricting surface 362, and the elastic member may be a compression spring.

Figure 18:
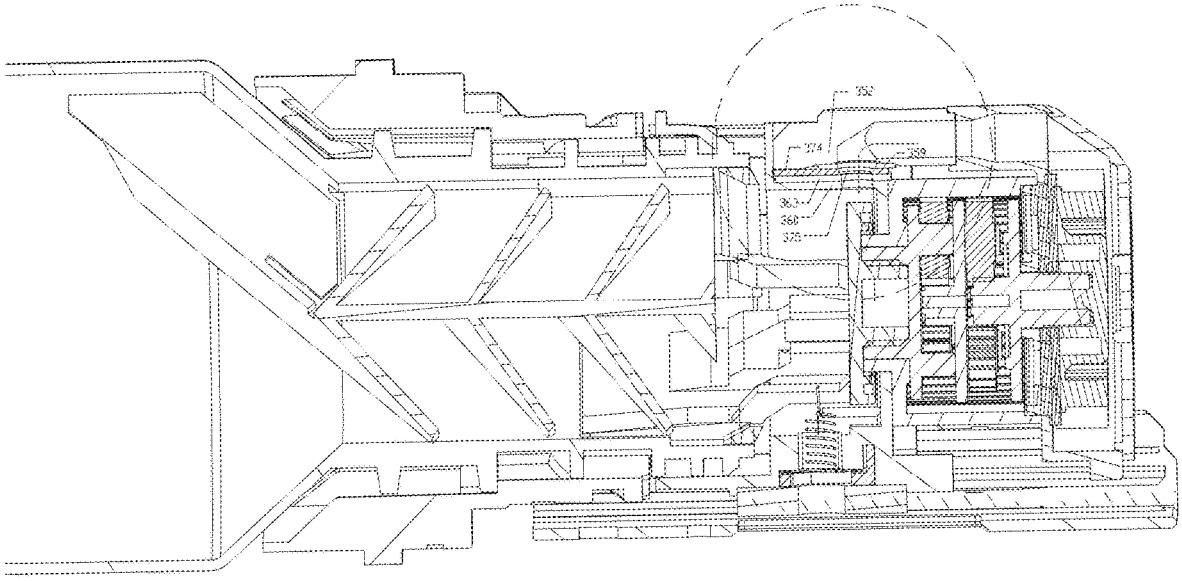
FIG. 18 illustrates a cross-section view of toner cartridge along a plane including the rotation axis of the toner cartridge, consistent with various embodiments of the present disclosure.
Figure 19:
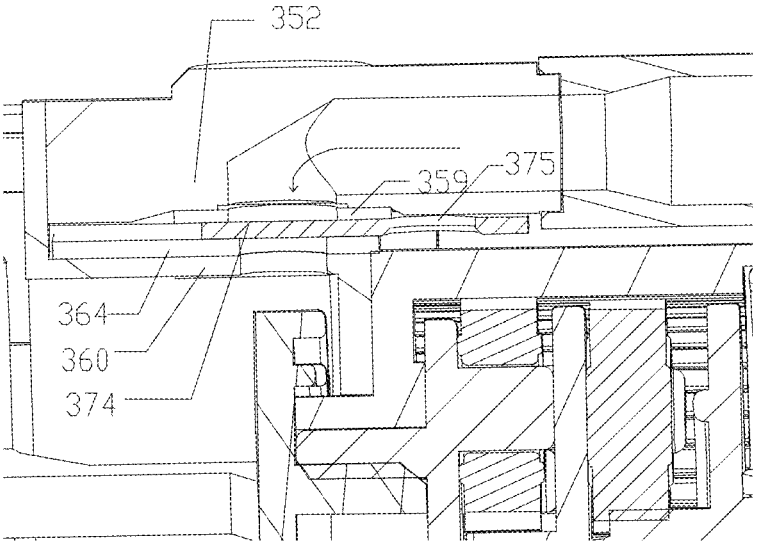
FIGS. 19-20 illustrate a cross-section view of a push rod in different status, consistent with various embodiments of the present disclosure.
Figure 20:
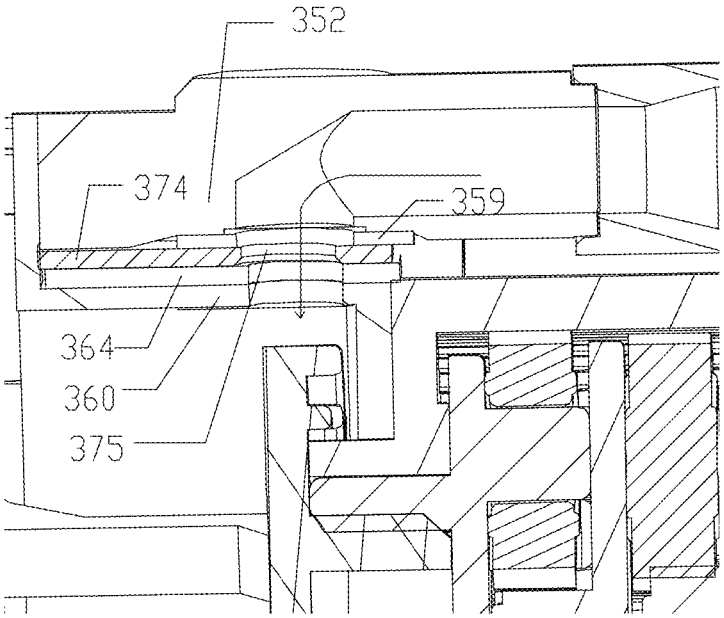

FIG. 18 shows a cross-sectional view obtained by cutting the toner cartridge along a plane passing through the rotation axis of the toner cartridge, and the cartridge body of the toner cartridge is on the left side of the figure. FIG. 19 and FIG. 20 are enlarged views of a dotted frame portion in FIG. 18. Among them, FIG. 19 corresponds to the state when the push rod 370 is at the first position, and FIG. 20 corresponds to the state when the push rod 370 is at the second position. As shown in FIG. 19, when the push rod 370 is at the first position, the air duct 352 and the toner mixing unit 360 may be blocked by the blocking surface 374. When the planetary gear works to generate wind, the wind cannot enter the toner mixing unit 360. Similarly, in this state, the developer cannot enter the planetary gear if the toner cartridge is shaken due to transportation and handling. As shown in FIG. 20, when the push rod 370 is at the second position, the push rod 370 may move toward the cartridge body of the toner cartridge, to make the through hole 375 and the connecting parts between the air duct 352 and the toner mixing unit 360 coincide, correspondingly the air flow generated by the planetary gear can smoothly enter the toner mixing unit 360.

Preferably, seals may be disposed at one side of the toner mixing unit 360 near the push rod 370 and one side of the air duct 352 near the push rod 370 respectively, that is, a first seal 359 in contact with the air duct 352 and the push rod 370, and a second seal 364 in contact with the toner mixing unit 360 and the push rod 370. The seals may avoid powder leakage that could contaminate other components in the toner cartridge during the transfer process and air leakage affecting work efficiency. Preferably, the seals may be made of foamed cotton, sponge, rubber pad, and so on.

Toner may be hard to enter the toner cartridge due to airflow and position during the operation of the powder cartridge. For further precaution, it is preferable to provide a filter in the air duct 352. In order to facilitate production, the filter may be preferably disposed on a side where the air duct 352 contacts the push rod 370.

Another embodiment of the present disclosure provides another toner cartridge and another toner discharging structure, which is an improvement on the above embodiment. To prevent the developer from accumulating at the toner outlet and being unable to enter the electronic imaging device, a powder outlet stirring blade may be introduced in this embodiment. The solution described in this embodiment is a method for directly implementing the planetary gear structure solution. Of course, it can also be used in a motor solution through simple deformation. The parts in this embodiment are the same as those in the first embodiment unless otherwise explained. For description purposes only, the present embodiment uses the planetary gear as an example to illustrate the present disclosure and should not limit the scopes of the present disclosure. In other embodiments, the structure can be also used in the toner cartridge driven electrically.

Figure 21:
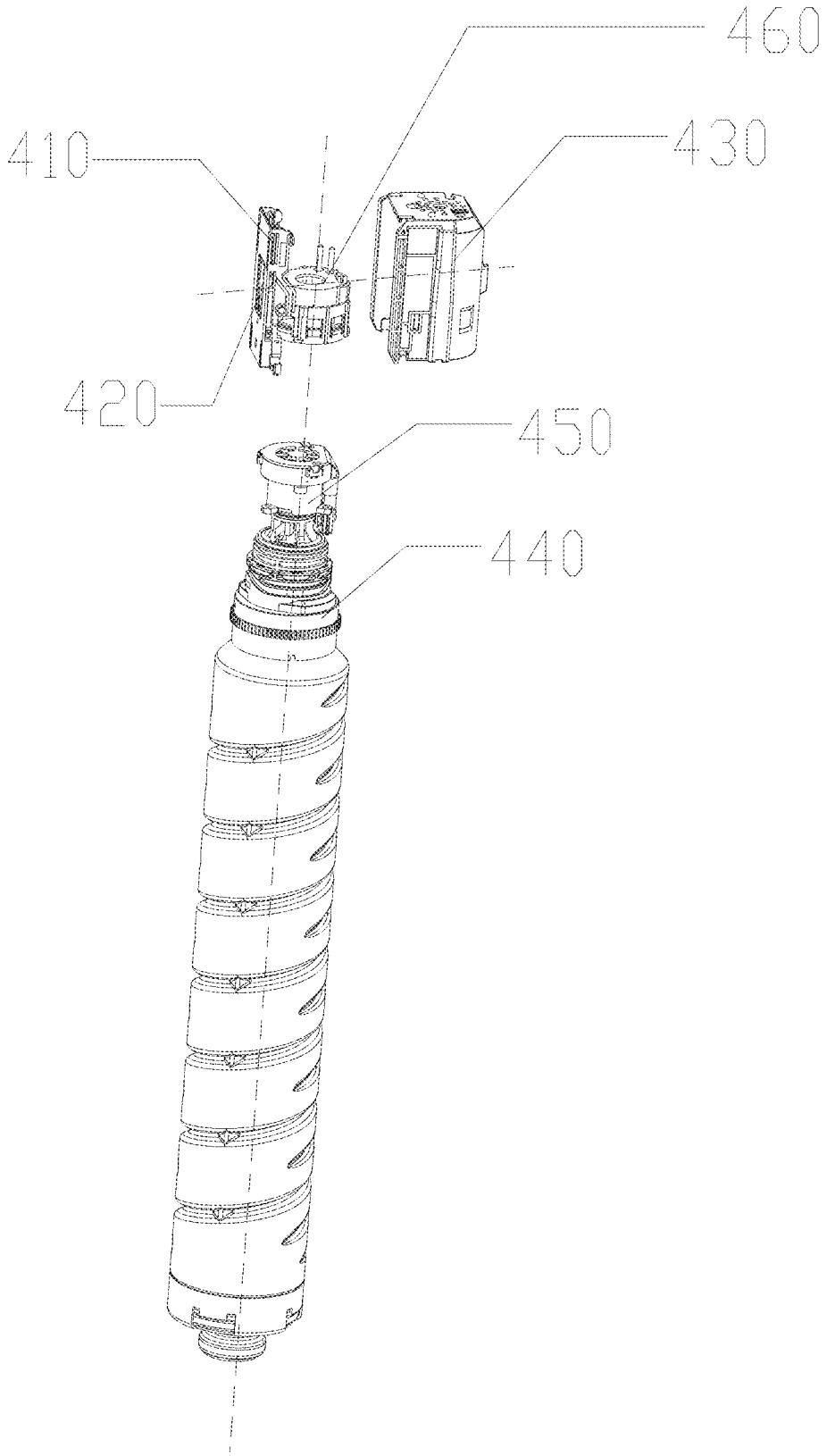
FIG. 21 illustrates an exploded view of another toner discharging structure, consistent with various embodiments of the present disclosure.

FIG. 21 shows an exploded view of the toner discharging structure. FIG. 21 is only used as an example to illustrate the internal structure and the actual structure may be different. Similar to the previous embodiments, the toner discharging structure may include a fixed toner outlet plate 410, a movable toner outlet plate 420, a frame 430, a connection unit 440, a mechanical blowing component 450, and a toner mixing unit 460.

Figure 22:
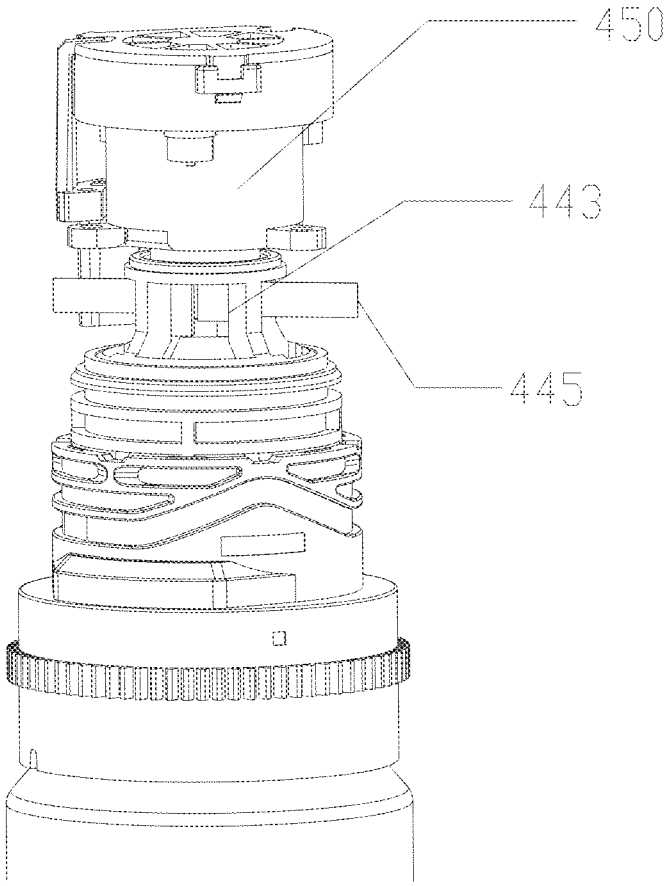
FIG. 22 illustrates an exemplary structure of a connection component and a mechanical blowing component consistent with various embodiments of the present disclosure.

FIG. 22 is a structural view of the connection unit 440 and the mechanical blowing component 450 in the toner discharging structure. A shape of a developer outlet 443 in this embodiment may be different from the previous embodiments, while the functions are similar. In the present embodiment, toner outlet stirring blades 445 may protrude from the developer outlet 443. Preferably, there may be two toner outlet stirring blades 445. Each of the toner outlet stirring blades 445 may include a fixed end and a free end. The fixed end may be fixed on the connection unit 440 and the free end may be fixed on the toner output plate 410 after being assembled. A projection of the free end to a plane passing the rotation axis of the toner cartridge may partially overlap a projection of the toner outlet 411 (see FIG. 25) to the plane passing through the rotation axis of the toner cartridge in at least one position. The toner outlet stirring blades 445 may rotate to help the toner dispense when the toner outlet 411 is not blocked. When the toner outlet 411 is blocked, the toner outlet stirring plates 445 may blow up the developer blocking the toner outlet 411 to alleviate the blockage.

Figure 23:
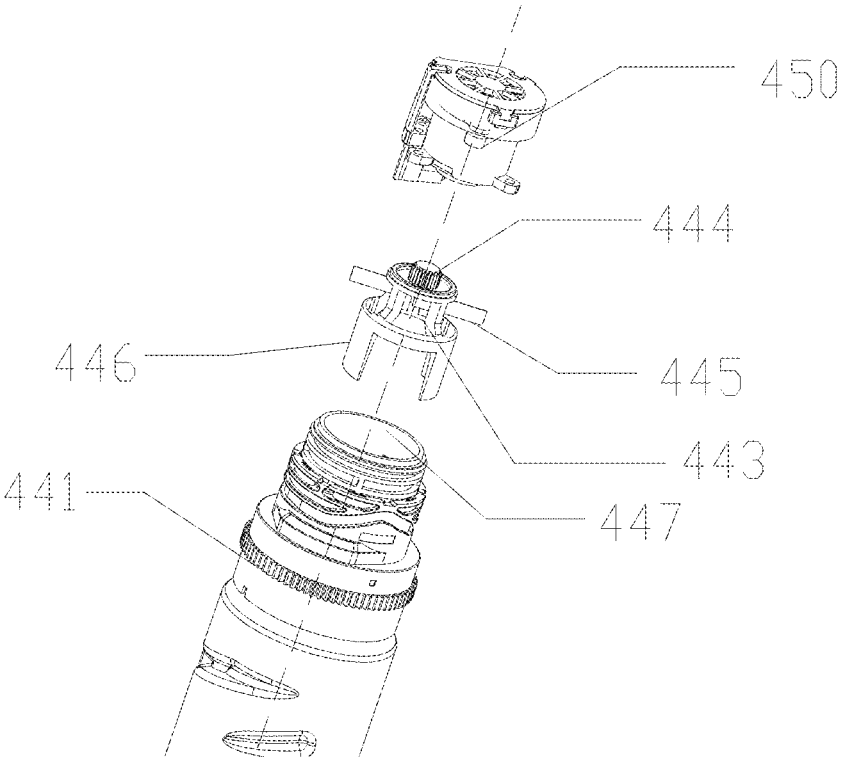
FIG. 23 illustrates an exploded view of a connection component and a mechanical blowing component consistent with various embodiments of the present disclosure.
Figure 24:
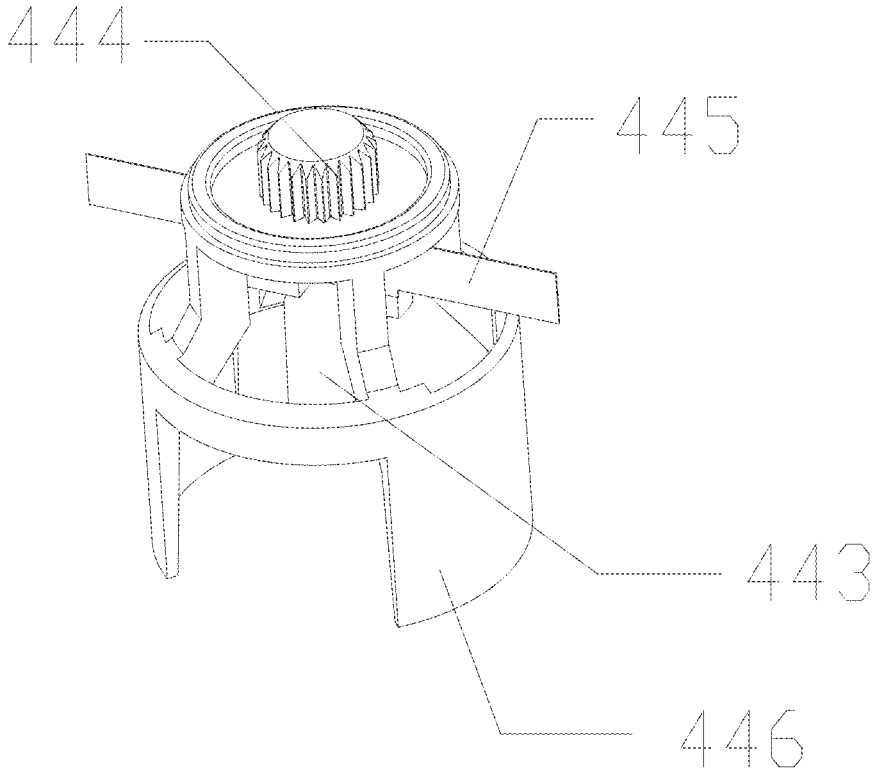
FIG. 24 illustrates a three-dimensional view of a first connection component consistent with various embodiments of the present disclosure.

FIG. 23 is an exploded view of the connection unit 440 and the mechanical blowing component 450 in the toner discharging structure. As shown in FIG. 23, to reduce the difficulty of the production process, the connection unit 440 in the present embodiment may be divided into two parts including a first connecting portion in contact with the toner cartridge and a second connecting portion in contact with the mechanical blowing component 450. FIG. 24 is a three-dimensional view of the first connecting portion. Similar to the input shaft 144 in the previous embodiments, the input shaft 444 in the present embodiment may be disposed on the first connecting portion. Preferably, the surface of the input shaft 444 may be provided with a tooth pattern to be engaged with the planetary gear. The second connecting portion may include a teeth circle 441 for receiving force from the electronic imaging device. The first connecting portion may further include a base 446 for connecting with the second connecting portion. Preferably, the base 446 can be connected to an inner wall 447 of the second connecting portion through a common method in the mechanical field including bonding, welding, threading, and snapping. Correspondingly, the first connecting portion and the second connecting portion are integrated. When the toner cartridge is installed into the electronic imaging device for work, the fixed toner output plate 410, the movable toner output plate 420, the frame 30, the mechanical blowing component 450, and the toner mixing unit 460 may be fixed relative to the electronic imaging device, and only the connection unit 440 and the cartridge body of the toner cartridge connected with the connection unit 440 may rotate relative to the electronic imaging device around its own rotation axis.

In one embodiment, to make the toner dispensing smoother, the toner outlet stirring blades 445 may preferably be elastic pieces, and protrusion blocks may be disposed inside the toner mixing unit 460 to make the toner outlet stirring blades 445 deform elastically. A number of the toner outlet stirring blades 445 may be two.

Figure 25:
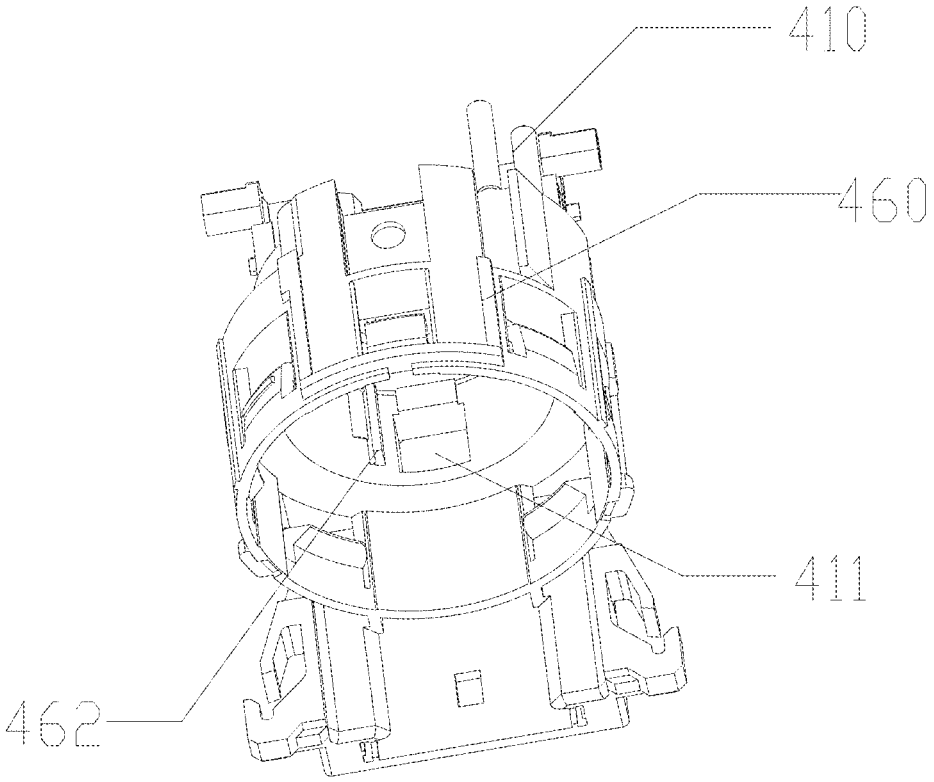
FIG. 25 illustrates a three-dimensional view of a toner mixing unit and a fixed toner outlet plate consistent with various embodiments of the present disclosure.

FIG. 25 is a three-dimensional view of the toner mixing unit and the fixed toner outlet plate. As illustrated in FIG. 25, the toner outlet 411 may be disposed at a connecting position of the toner mixing unit 460 and the fixed toner outlet plate 410. The protrusion blocks 462 may be disposed at an upstream position of a rotation direction of the toner outlet stirring blades 445 with respect to the toner outlet 411. The protrusion blocks 462 may be disposed at the inner wall of the toner mixing unit 460 and may protrude from the inner wall. A projection of the protrusion blocks 462 to the plane passing through the rotation axis of the toner cartridge may partially overlap a projection of the free ends of the toner outlet stirring blades 445 to the plane passing through the rotation axis of the toner cartridge at least in one position. When the connection unit 440 drives the toner outlet stirring blades 445 to rotate with respect to the toner mixing unit 460, the protrusion blocks 462 may interfere with the toner outlet stirring blades 445, to make the toner outlet stirring blades 445 deform elastically and accumulate elastic potential energy. After that, the toner outlet stirring blades 445 may continue moving and leave the protrusion blocks 462. The accumulated potential energy of the elastic deformation then may be released. Correspondingly, the toner outlet stirring blades 445 may operate at the position of the toner outlet 411, to facilitate the toner dispensing and alleviate the blockage more efficiently.

In some embodiments where the requirements for the toner dispensing amount are not too strict, the planetary gear structure may be reduced, and only the toner outlet stirring blades may be kept to save costs.

Another embodiment of the present disclosure provides another toner cartridge and another toner discharging structure, which is an improvement of the previous embodiment. The present embodiment is a further improvement on the structure of the toner outlet stirring blades, and more specifically, it is a further simplification after eliminating the planetary gear structure, thereby to further saving costs.

A stirring member is often provided near the toner outlet of the toner cartridge to help the developer inside the toner cartridge to flow out. The stirring member is fixed to the toner cartridge. When the toner cartridge is installed in the electronic imaging device, the stirring member and the toner cartridge rotate together. As the toner cartridge rotates, a pattern of the toner cartridge and the spiral structure on the surface of the stirring member make the developer flow from an opening of the toner cartridge along the stirring member.

Figure 26:
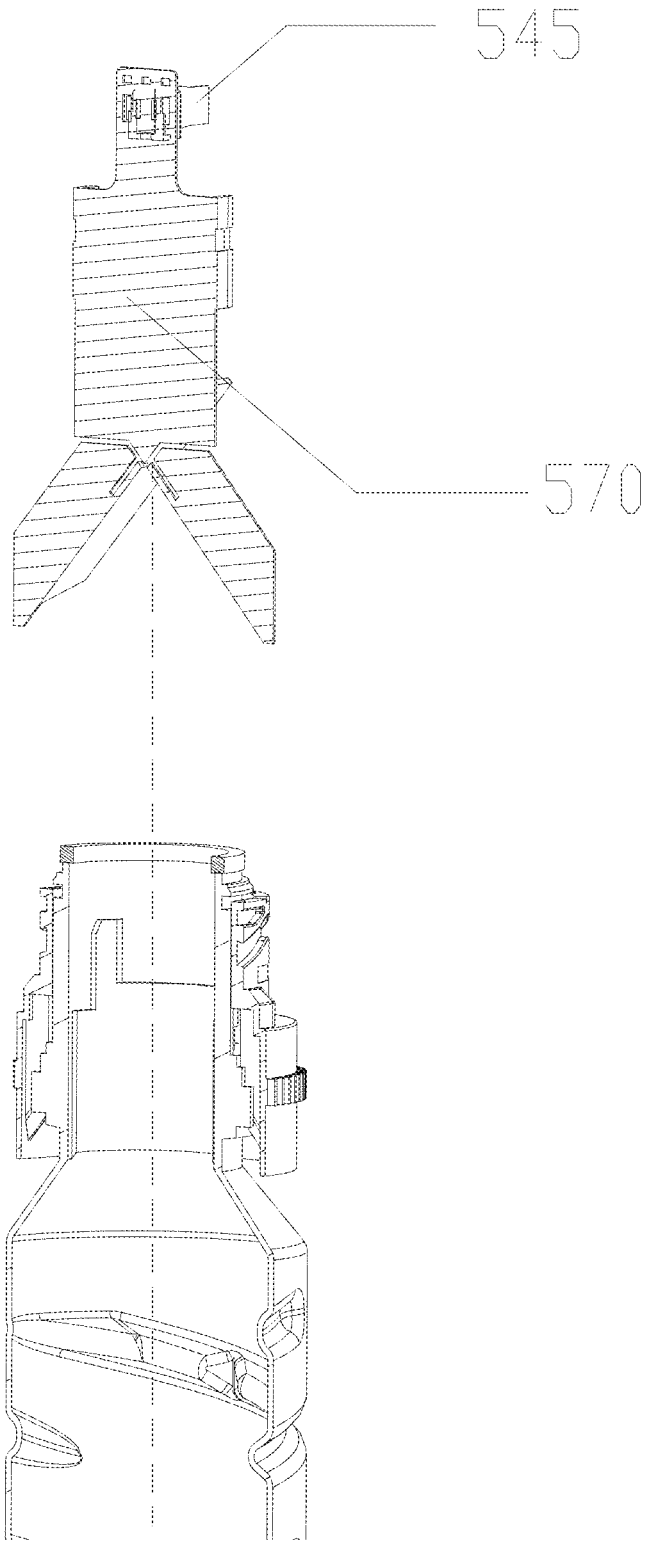
FIG. 26 illustrates a cross-section view of a stirring member and a cartridge body along a plane including the rotation axis of the toner cartridge, consistent with various embodiments of the present disclosure.
Figure 27:
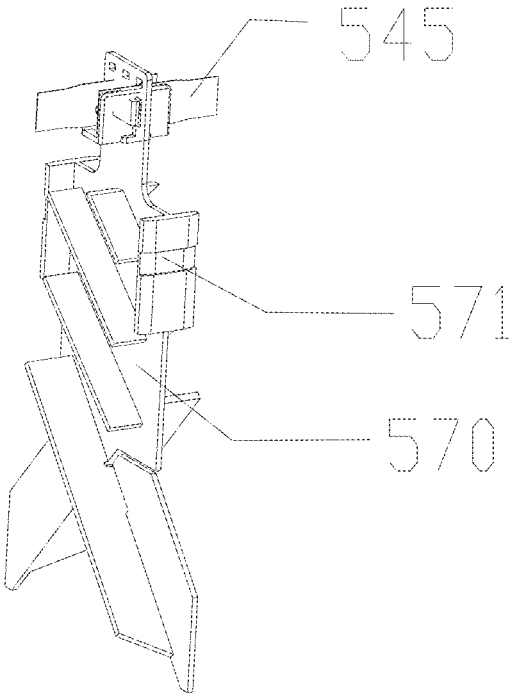
FIG. 27 illustrates a three-dimensional view of a stirring member consistent with various embodiments of the present disclosure.

In the present embodiment, to reduce costs and simplify components, the connection unit in the previous embodiment may be no longer provided and the toner outlet stirring blades 545 may be disposed directly on the stirring member 570. FIG. 26 is an exploded view of the stirring member and the cartridge body of the toner cartridge after being cut along a surface passing through the rotation axis of the toner cartridge, and FIG. 27 is a three-dimensional view of the stirring member. The present embodiment may still use the toner mixing unit 460 and the protrusion blocks 462 same as in the fourth embodiment, and a combination of the stirring member 570 and the toner outlet stirring blades 545 may achieve a same effect that the connection unit 440 in the previous embodiments drives the toner outlet stirring blades 445 to interfere the protrusion blocks 462. Preferably, the stirring member 570 may be connected to the cartridge body of the toner cartridge through a buckle 571.

Another embodiment of the present disclosure provides a further improvement on the previous embodiment. In the present embodiment, the toner cartridge may not use the planetary gear structure and may be easier to discharge the developer than the structure in the previous embodiment. The present embodiment mainly improves the internal structure of the toner mixing unit.

Figure 28:
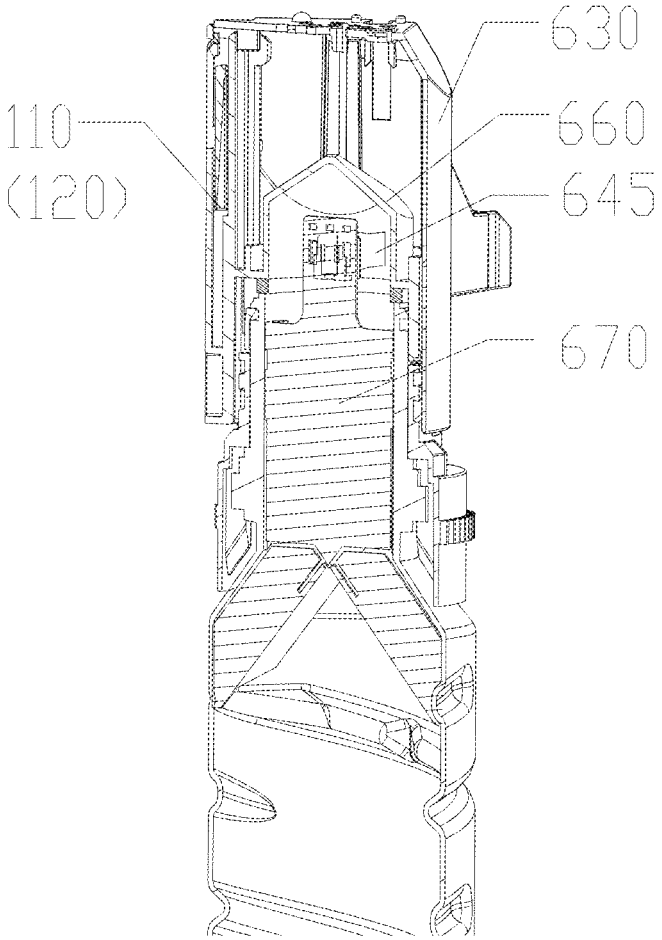
FIG. 28 illustrates a cross-section view of a developer outlet structure along a plane including the rotation axis of the toner cartridge, consistent with various embodiments of the present disclosure.
Figure 29:
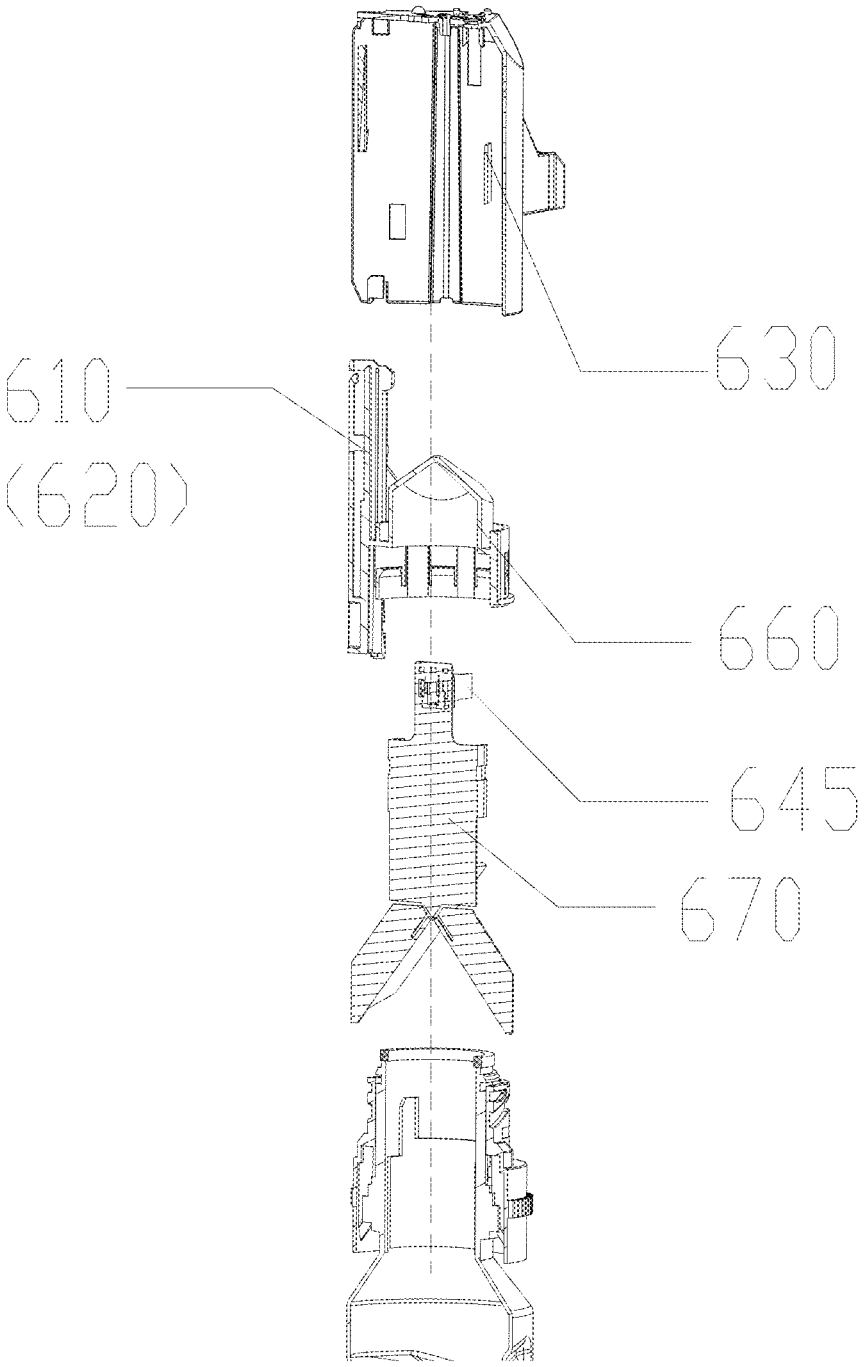
FIG. 29 illustrates an exploded cross-section view of a developer outlet structure along a plane including the rotation axis of the toner cartridge, consistent with various embodiments of the present disclosure.

FIG. 28 is a cross-sectional view of the developer discharging structure cut along the plane passing through the rotating axis of the cartridge body of the toner cartridge, and FIG. 29 is an exploded view of the developer discharging structure cut along the plane passing through the rotating axis of the cartridge body of the toner cartridge. In the present embodiment, the frame 630, the fixed toner outlet plate 610, and the movable toner outlet plate 620 may have the same structure as those in the first embodiment, and the stirring member 670 and the toner outlet stirring blades 645 may have the same structures as those in the previous embodiment. The present embodiment mainly improves the structure of the toner mixing unit 660.

Figure 30:
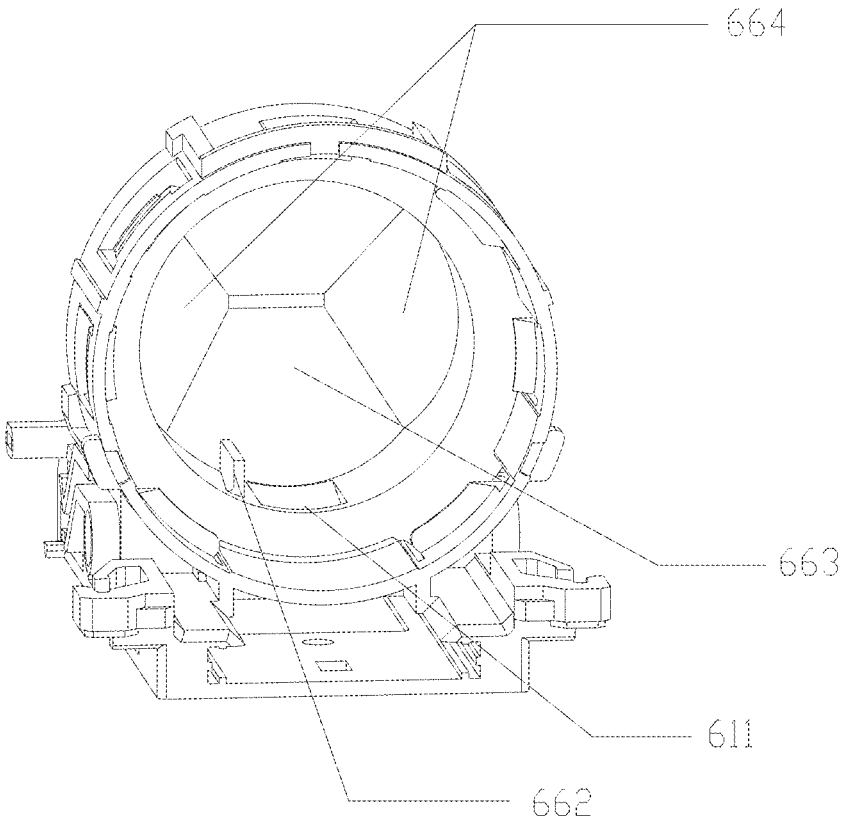
FIG. 30 illustrates an internal structure of a toner mixing unit consistent with various embodiments of the present disclosure.
Figure 31:
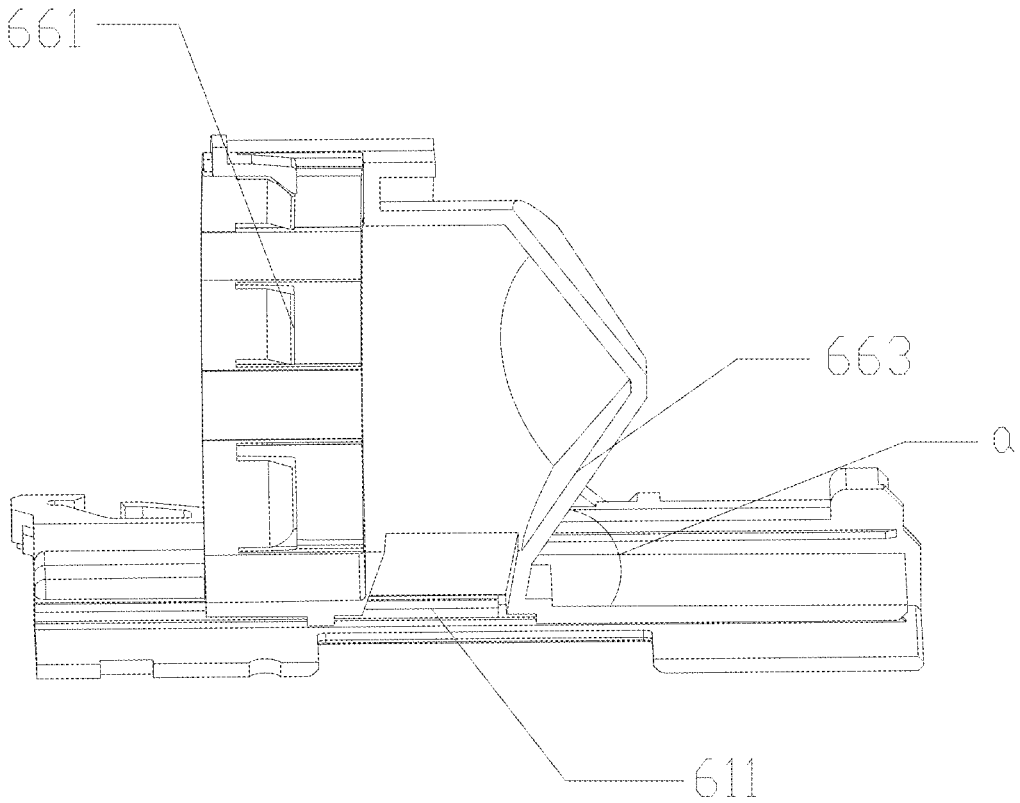
FIG. 31 illustrates a cross-section view of a toner mixing unit along a plane including the rotation axis of the toner cartridge, consistent with various embodiments of the present disclosure.

FIG. 30 is a schematic structural view of the inside of the toner mixing unit viewed from the vicinity of one side of the cartridge body of the toner cartridge, and FIG. 31 is a cross-sectional view of the toner mixing unit cut along a surface passing through the rotation axis of the cartridge body of the toner cartridge. The toner mixing unit 660 may include protrusion blocks 662 similar to the one in the previous embodiments, which is used to interfere with the toner outlet stirring blades 645. The toner mixing unit 660 may further include a buckle 661 similar to the one in the previous embodiments which is used for fixing the toner mixing unit 660. Correspondingly, the toner mixing unit 660 and the cartridge body of the toner cartridge may rotate relative to each other without detaching from each other. The toner mixing unit 660 may further include a toner guiding slope 663. The toner guiding slope 663 and the rotation axis of the cartridge body of the toner cartridge may form an acute angle. The angle toner guiding slope 663 and the rotation axis of the cartridge body of the toner cartridge may equal to an angle a between the toner guiding slope 663 and the fixed toner outlet plate 610, correspondingly the angle a may also be an acute angle. The toner discharge may be facilitated. Preferably, the angle may be between 30 degrees to 60 degrees. A powder outlet 611 for fixing the powder outlet plate 610 toner may be disposed below the toner guiding slope 663, that is, below the gravity direction.

Preferably, the toner mixing unit 660 may further include an auxiliary surface 664, for assisting the developer to flow to the toner guiding slope 663.

When the toner cartridge works in the electronic imaging device, only the stirring member 670 and the cartridge body of the toner cartridge may rotate. The frame 630, the fixed toner output plate 610, the movable toner output plate 620, and the toner mixing unit 660 may be relatively fixed with the electronic imaging device. The stirring member 670 may drive the developer stored in the cartridge body of the toner cartridge into the toner mixing unit 660 and may cause the developer to slide on or act on the toner guiding slope 663. Due to the effect of the gravity, the developer may slide downward along the toner guiding slope 663 in the direction of gravity and leave the toner outlet 611. At the same time, the developer on the toner guiding slope 663 near the direction of gravity may also help the developer close to the lower of part the gravity direction. Therefore, compared with the structure in the previous embodiments, the toner guiding slope 663 may facilitate the toner discharge.

Figure 32:
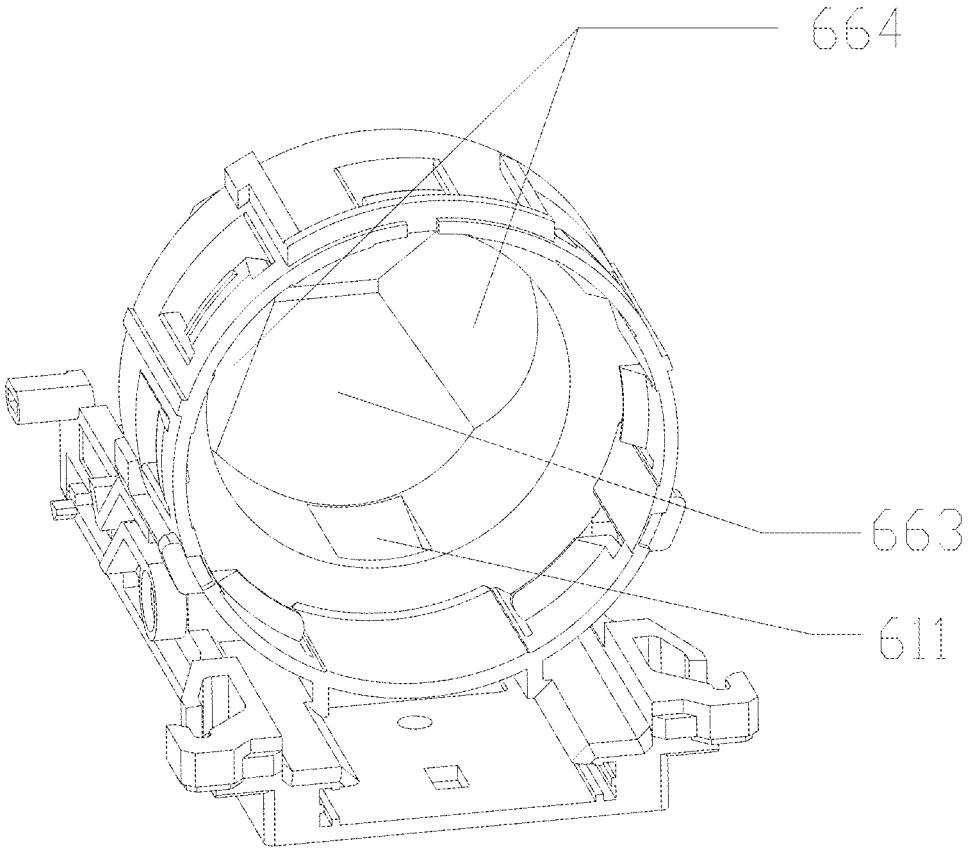
FIG. 32 illustrates an internal structure of another toner mixing unit consistent with various embodiments of the present disclosure.

Further, for a toner cartridge that does not require high toner output, there is a further cost saving solution in this embodiment. FIG. 32 is a schematic structural view of the inside of another toner mixing unit viewed near one side of the toner cartridge, in another embodiment. In this modification, the protrusion blocks 662 may be eliminated, and a non-elastic stirring structure may be used instead of the toner outlet stirring blades 645. The developer may be driven to flow out by gravity only through the toner guiding slope 663. This may further save the price of the elastic plates, and at the same time increase the life of the toner cartridge, so that the performance of toner cartridge may not be affected due to the fatigue of the elastic plates.

Another embodiment of the present disclosure provides a structure for discharging toner close to the toner outlet. The toner cartridge without the blowing structure and the toner outlet stirring plates described in previous embodiments may use the structure in the present embodiment.

Figure 33:
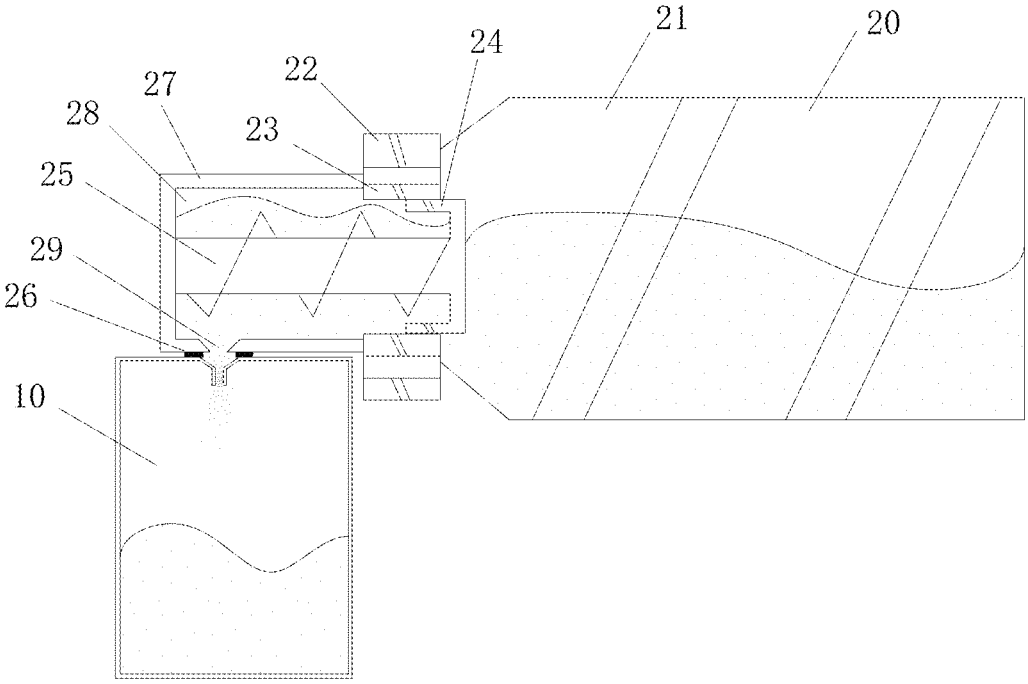
FIG. 33 illustrates a screw toner feeding structure consistent with various embodiments of the present disclosure.

FIG. 33 shows a screw toner feeding structure. As shown in FIG. 33, the toner cartridge 20 may include a cartridge body 21 containing developer. One end of the cartridge body 21 may be closed and another end may have an opening. The end of the cartridge body 21 with the opening may be provided with a frame 27, and the frame 27 may seal the opening in the cartridge body 21. The end of the cartridge body 21 close to the frame 27 may include a driving gear 22. The driving gear 22 may be used to receive the driving force from the electronic imaging device, thereby driving the cartridge body 21 to rotate.

A toner mixing unit 28 may be disposed inside the frame 27, and may be used to receive the developer from the cartridge body 21. A screw rod 25 may be disposed inside the toner mixing unit 28, and a transmission gear 24 may be disposed at one end of the screw rod 25, and another end of the screw rod 25 may be rotatably mounted on the toner mixing unit 28. A toner outlet 29 may be disposed at a bottom of the toner mixing unit 28, and a sealing ring 26 may be disposed around the toner outlet 29. An inner gear 23 may be disposed at one end of the cartridge body 21. The transmission gear 24 may be engaged with the inner gear 23, to transmit the driving force received by the driving gear 22 to the screw rod 25. Then the screw rod 25 may be driven to rotate to transmit the developer to the toner outlet 29.

When the toner cartridge 20 is mounted in the electronic imaging device, the toner outlet 29 may correspond to a developer receiving part 10 in the electronic imaging device. The developer receiving part 10 may receive the developer from the toner cartridge 20. The driving gear 22 may receive the driving force of the electronic imaging device to drive the cartridge body 21 to rotate. The rotation of the cartridge body 21 may transmit the developer in the cartridge body 21 to the toner mixing unit 28 in the frame 27. The transmission gear 24 of the screw rod 25 may be engaged with the inner gear 23 of the cartridge body 21, to transmit the driving force to the screw rod 25. The screw rod 25 may rotate to transmit the developer accumulated in the toner mixing unit 28 to the toner outlet, to complete the transmission of the developer. In one embodiment, preferably, the inner gear 23 and the driving gear 22 may be formed integrally.

The screw rod 25 disposed inside the toner mixing unit 28 may effectively alleviate the accumulation of the developer in the toner mixing unit 28, and may make the developer be transmitted to the developer receiving part 10 inside the electronic imaging device effectively. Efficiency and stability of the developer transmission may be improved.

The above structure may also cooperate with other structures to facilitate the toner discharge of the toner outlet. In some other embodiments, the above structure may be disposed independently.

Figure 34:
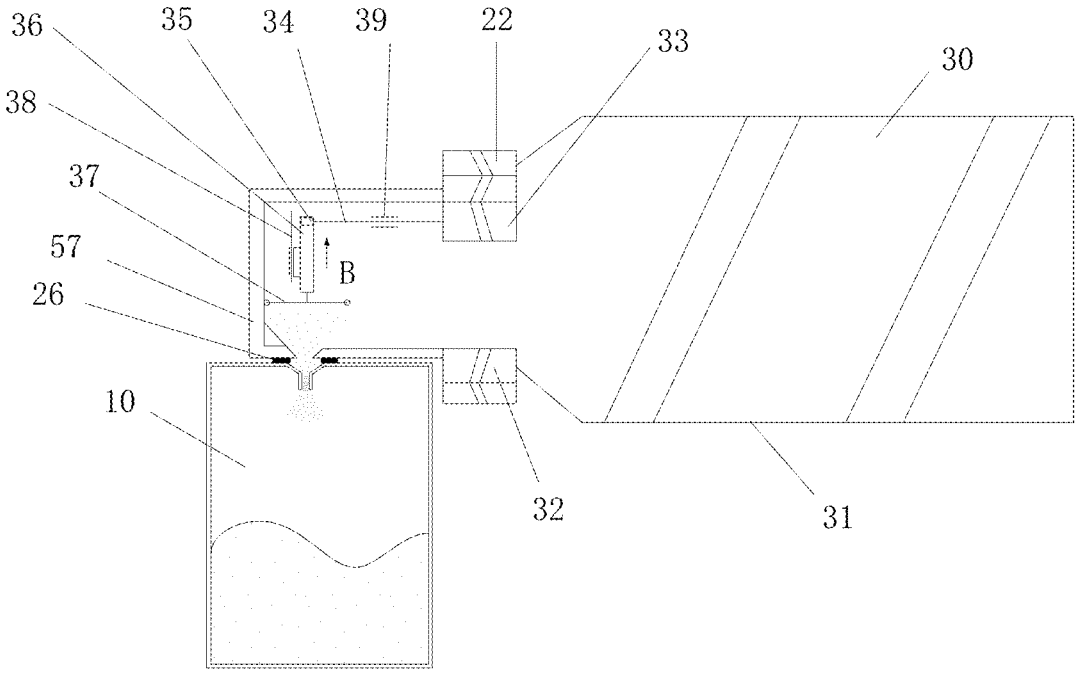
FIGS. 34-35 illustrate schematics of toner discharge with elastic films consistent with various embodiments of the present disclosure.
Figure 35:
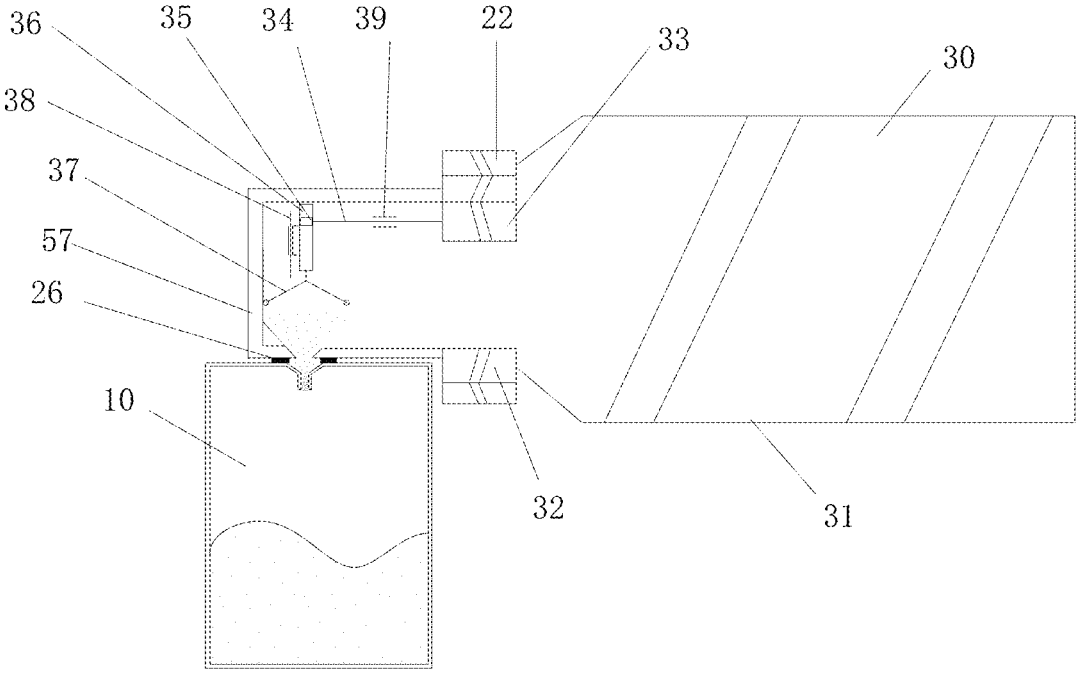

FIGS. 34-35 illustrate a schematic of toner discharge with elastic films. As illustrated in FIGS. 34-35, the toner cartridge 30 may include a cartridge body 31 containing developer. One end of the cartridge body 31 may be closed and another end may have an opening. The end of the cartridge body 31 with the opening may be provided with a frame 57, and the frame 57 may seal the opening in the cartridge body 31. The end of the cartridge body 31 close to the frame 57 may include a driving gear 22. The driving gear 22 may be used to receive the driving force from the electronic imaging device, thereby driving the cartridge body 31 to rotate.

A toner mixing unit may be disposed inside the frame 57, and may be used to receive the developer from the cartridge body 31. A teeth rack 36 may be disposed inside the toner mixing unit and an elastic film 37 may be disposed at one end of the teeth rack 36. The teeth rack 36 may move along a guide rail 38 disposed in the toner mixing unit in a direction B or in a direction opposite to the direction B. The teeth rack 36 may be engaged with a missing-teeth gear 35. The transmission gear 33 may be connected to the missing-teeth gear 35 through a connection rod 34, to transmit the driving force to the missing-teeth gear 35 through the connection rod 34. The connection rod 34 may be rotatably mounted in the toner mixing unit. A toner outlet may be disposed at a bottom of the toner mixing unit and a sealing ring 26 may be disposed around the toner outlet. The connection rod 34 may be rotatably fixed in the frame 57 by a support 39.

Figure 36:
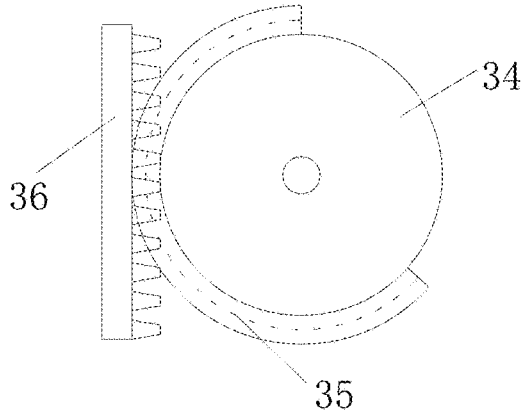
FIG. 36 illustrates an engagement relationship between the connection rod, the missing-teeth gear, and the teeth rack, consistent with various embodiments of the present disclosure.

FIG. 36 illustrates an engagement relationship between the connection rod 34, the missing-teeth gear 35, and the teeth rack 36. An inner gear 32 may be disposed at the end of the cartridge body 31 with the opening, and the transmission gear 33 may be engaged with the inner gear 32 to transmit the driving force received by the driving gear 22 to the teeth rack 36. Correspondingly, the elastic film 37 may be driven to move back and forth along the moving direction B and the direction opposite to the direction B, to transmit the developer to the toner outlet. The missing-teeth gear 35 may be formed by removing a portion of the teeth in a complete cylindrical spur gear, as shown in FIG. 36.

When the toner cartridge 30 is mounted in the electronic imaging device, the electronic imaging device may drive the driving gear rotate, and the driving gear 22 may drive the cartridge body 31 to rotate. The inner gear 32 may rotate with the cartridge body 31 and transmit the driving force to the transmission gear 33. The transmission gear 33 may drive the missing-teeth gear 35 through the connection rod 34. In a first stage, when the missing-teeth gear 34 rotates to a position with teeth and engaged with the teeth rack 36, the teeth rack 36 may drive the elastic film 37 moving from a first position to a second position. In this process, a semi-closed space formed by the elastic film 37 and the surrounding frame 57 may increase. Since the cartridge body 31 rotates to transmit the toner, the developer may gradually fill the gradually increased space formed by the elastic film 37. In a second stage, when the missing-teeth gear 34 rotates to a position without teeth, the teeth rack 36 may be separated from the missing-teeth gear 35. The elastic film 37 may quickly rebound because the elastic film 37 is no longer pulled by an external force. The semi-closed space formed by the elastic film 37 and the surrounding frame 57 may shrink quickly to form a high pressure region, and the elastic film 37 may return to the first position from the first position. The developer in the high pressure region may be forced to be ejected from the toner outlet due to the high pressure and fall into the electronic imaging device, to achieve the toner supply. When the missing teeth gear 35 rotates to the position engaged with the teeth rack 36 again, the toner supply operation may start to enter the next cycle.

The present embodiment also provides another structure that may facilitate the toner discharge at the toner outlet.

Figure 37:
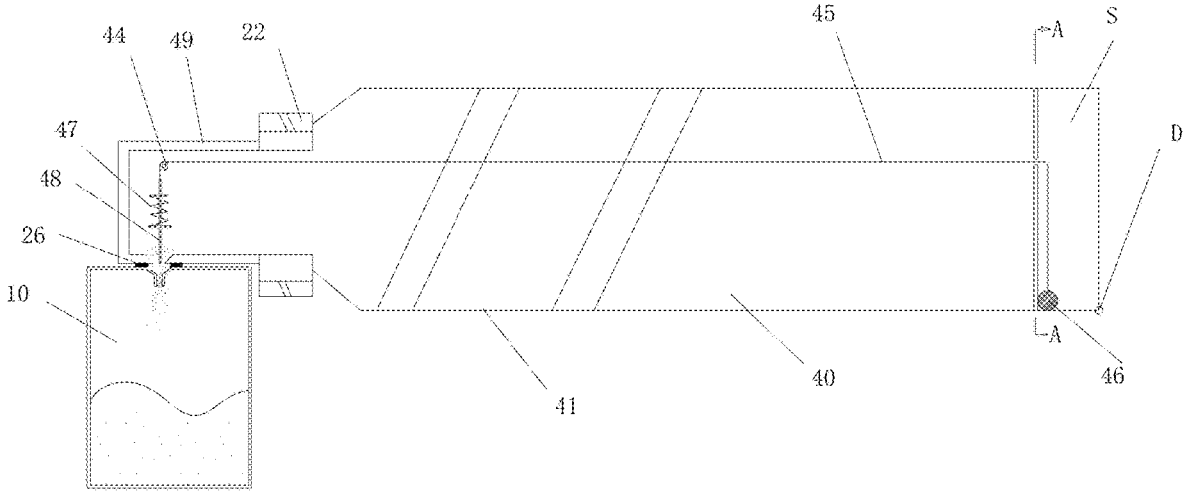
FIG. 37 illustrates a structure with ball toner discharging consistent with various embodiments of the present disclosure.
Figure 38:
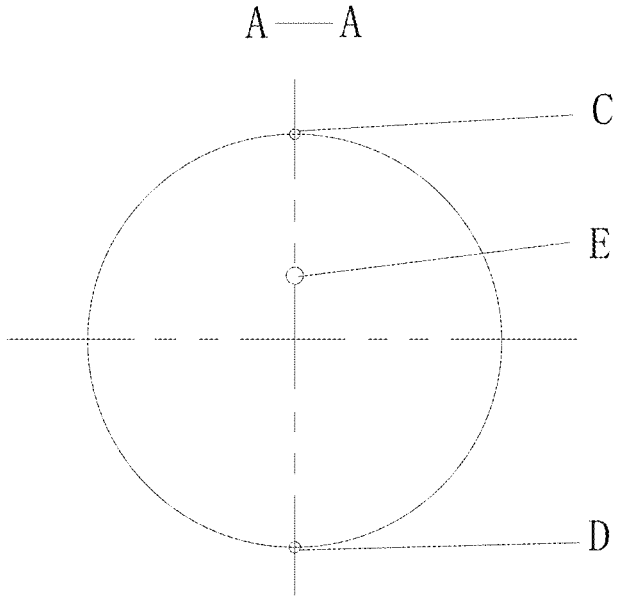
FIG. 38 illustrates a cross-section view along an A-A direction in FIG. 37, consistent with various embodiments of the present disclosure.

FIG. 37 illustrates a structure with a ball toner discharge, and FIG. 38 shows a cross-section view of the structure in FIG. 37 along an A-A direction. As illustrated in FIGS. 37-38, the toner cartridge 40 may include a cartridge body 41 containing developer. One end of the cartridge body 41 may be closed and another end may have an opening. The end of the cartridge body 41 with the opening may be provided with a frame 49, and the frame 49 may seal the opening in the cartridge body 41. The end of the cartridge body 41 with the opening may include a driving gear 22. The driving gear 22 may be used to receive the driving force from the electronic imaging device, thereby driving the cartridge body 41 to rotate. A space S may be formed separately in the close end of the cartridge body 41, and a heavy shot 46 with a smooth surface may be disposed in the space S. The shot 46 may be connected to a telescopic mechanism of the toner cartridge through a string 45. The gravity of the shot 46 may be much greater than the spring force of a light spring 47 in the telescopic mechanism. The string 45 may enter the space S through a hole E. The hole E may deviate from the rotation center of the cartridge body 41. One end of a diameter of the cartridge body 41 passing through the hole E close to the hole E may be designated as a point C, and another end away from the hole E may be designated as a point D.

The telescopic mechanism may include a pin 48, the light spring 47, a pulley 44 and a string 45. The pulley 44 may be fixed in the toner mixing unit of the frame 49. One end of the light spring 47 may be connected to the string 45 and another end may be connected to the pin 48. The pin 48 may be disposed above the toner outlet. The driving gear 22 may drive the toner cartridge 40 to rotate. Due to the effect of gravity, the shot 46 may always fall on the bottom of the space S in which it is located. With the rotation of the cartridge body 41, when the point D of the cartridge body is rotated to the bottom of the cartridge body 41, the string 45 may be stretched, and the weight of the shot 46 may make the light spring 47 contract. The position of the pin 48 may rise to the top.

As the cartridge body 41 continues to rotate, when the position of the point D of the cartridge body 41 starts to leave the lowest point, the light spring 47 may gradually recover and drive the pin 48 to push the developer downward until the point C of the cartridge body is at the lowest point. The pin 48 may reach the bottom end, pushing the developer completely into the developer receiving part 10 of the electronic imaging device. The toner cartridge may continue to rotate, and the shot 46 may pull the pin 48 up again through the string 45 until the position of point D of the cartridge body reaches the lowest point and the pin 48 reaches the top point. The cartridge body 41 may continue to rotate and start the next cycle.

When removing the toner cartridge, to avoid interference between the pin 48 and the toner inlet of the developer receiving part 10, the operator may be particularly reminded to make the point D of the cartridge body reach the lowest point by rotating the cartridge body 41 and then remove the powder cartridge 40. In this way, the pin 48 may rise to the top and may not interfere with the toner inlet of the developer receiving part 10. It may be ensured that the normal close of the toner outlet of the toner cartridge will not be affected by the pin. In other embodiments, the thickness of the frame near the toner outlet may be set reasonably, to make the pin be located in a suitable position, and to avoid interference with the opening and closing of the pin and the toner outlet. It may be not necessary to rotate the toner cartridge to the lowest point.

In the present disclosure, an accelerating structure may be provided with the toner discharging structure. The accelerating structure may accelerate the toner cartridge with a low rotating speed to drive blades of a blower to rotate with a high speed with respect to the toner cartridge. Correspondingly, wind may be generated to blow air and the developer out through the toner outlet hole.

Various embodiments have been described to illustrate the operation principles and exemplary implementations. It should be understood by those skilled in the art that the present disclosure is not limited to the specific embodiments described herein and that various other obvious changes, rearrangements, and substitutions will occur to those skilled in the art without departing from the scope of the disclosure. Thus, while the present disclosure has been described in detail with reference to the above described embodiments, the present disclosure is not limited to the above described embodiments but may be embodied in other equivalent forms without departing from the scope of the present disclosure, which is determined by the appended claims.

What is claimed is:

1. A toner discharging structure cooperatively coupled with a cartridge body to form a toner cartridge used in an electronic imaging device, the toner discharging structure comprising:

an accelerating structure, wherein one end of the accelerating structure is connected to the cartridge body;

blowing blades, connected to another end of the accelerating structure to allow a rotation speed of the blowing blades greater than a rotation speed of the cartridge body;

a toner mixing unit, connected to the cartridge body, for receiving wind generated by the blowing blades; and a toner discharging unit, including a toner outlet connected to the toner mixing unit, wherein:

the toner mixing unit is configured to receive the wind generated by the blowing blades through an air duct;

the toner discharging structure further includes a push rod;

when the push rod is at a first position, the air duct is configured not to transmit the wind to the toner mixing unit; and when the push rod is at a second position, the air duct is configured to transmit the wind to the toner mixing a unit.

2. The toner discharging structure according to claim 1, wherein the accelerating structure is a planetary gear.

3. The toner discharging structure according to claim 2, wherein:

the planetary gear is a planetary gear structure with at least three stages;

the toner discharge structure further includes a connection unit respectively connected to the cartridge body and the accelerating structure;

the planetary gear structure includes a first stage planetary carrier, a first stage planetary pinion, a first stage sun gear, a second stage planetary pinion, a second stage sun gear, a third stage planetary pinion, and a third stage sun gear, arranged sequentially along a direction from the connection unit to the blowing blades;

the connection unit is connected to the first planetary carrier, and the third stage sun gear is connected to the blowing blades;

a ring gear is disposed at the connection unit for receiving a rotational driving force from the electronic imaging device;

the planetary gear structure further includes an outer ring gear connected to the toner mixing unit; and when the toner cartridge is in operation in the electronic imaging device, the toner mixing unit and the outer ring gear do not rotate.

4. The toner discharging structure according to claim 1, wherein:

a filter mesh or a check valve is disposed in the air duct.

5. The toner discharging structure according to claim 1, wherein:

the blowing blades are centrifugal blowing blades.

6. The toner discharging structure according to claim 1, wherein:

a toner outlet stirring plate is disposed inside the toner mixing unit;

the toner outlet stirring plate is configured to receive force from the cartridge body to rotate; and the toner outlet stirring plate overlaps the toner outlet in at least one position when the toner outlet stirring plate rotates.

7. The toner discharging structure according to claim 6, wherein:

the toner mixing unit further includes a toner guiding slope;

an angle between the toner guiding slope and a rotation axis of the cartridge body is an acute angle; and the toner outlet is located at a bottom of the toner guiding slope.

8. A toner discharging structure cooperatively coupled with a cartridge body to form a toner cartridge used in an electronic imaging device, the toner discharging structure comprising:

an accelerating structure, wherein one end of the accelerating structure is connected to the cartridge body;

blowing blades, connected to another end of the accelerating structure to allow a rotation speed of the blowing blades greater than a rotation speed of the cartridge body;

a toner mixing unit, connected to the cartridge body, for receiving wind generated by the blowing blades; and a toner discharging unit, including a toner outlet connected to the toner mixing unit, wherein:

a toner outlet stirring plate is disposed inside the toner mixing unit;

the toner outlet stirring plate is configured to receive force from the cartridge body to rotate;

the toner outlet stirring plate overlaps the toner outlet in at least one position when the toner outlet stirring plate rotates the toner outlet stirring plate is an elastic plate; and a protruding block is disposed at an inner wall of the toner mixing unit to allow the toner outlet stirring plate to deform.

9. The toner discharging structure according to claim 8, wherein the accelerating structure is a planetary gear.

10. The toner discharging structure according to claim 9, wherein:

the planetary gear is a planetary gear structure with at least three stages;

the toner discharge structure further includes a connection unit respectively connected to the cartridge body and the accelerating structure;

the planetary gear structure includes a first stage planetary carrier, a first stage planetary pinion, a first stage sun gear, a second stage planetary pinion, a second stage sun gear, a third stage planetary pinion, and a third stage sun gear, arranged sequentially along a direction from the connection unit to the blowing blades;

the connection unit is connected to the first planetary carrier, and the third stage sun gear is connected to the blowing blades;

a ring gear is disposed at the connection unit for receiving a rotational driving force from the electronic imaging device;

the planetary gear structure further includes an outer ring gear connected to the toner mixing unit; and when the toner cartridge is in operation in the electronic imaging device, the toner mixing unit and the outer ring gear do not rotate.

11. The toner discharging structure according to claim 8, wherein:

the toner mixing unit is configured to receive the wind generated by the blowing blades through an air duct;

the toner discharging structure further includes a push rod;

when the push rod is at a first position, the air duct is configured not to transmit the wind to the toner mixing unit; and when the push rod is at a second position, the air duct is configured to transmit the wind to the toner mixing unit.

12. The toner discharging structure according to claim 11, wherein:

a filter mesh or a check valve is disposed in the air duct.

13. The toner discharging structure according to claim 8, wherein:

the blowing blades are centrifugal blowing blades.

14. A toner cartridge for an electronic imaging device, comprising:

a cartridge body; and a toner discharging structure, cooperatively coupled with the cartridge body, wherein the toner discharging structure includes:

an accelerating structure, wherein one end of the accelerating structure is connected to the cartridge body, blowing blades, connected to another end of the accelerating structure to allow a rotation speed of the blowing blades greater than a rotation speed of the cartridge body, a toner mixing unit, connected to the cartridge body, for receiving wind generated by the blowing blades, and a toner discharging unit, including a toner outlet connected to the toner mixing unit, wherein:

the toner mixing unit is configured to receive the wind generated by the blowing blades through an air duct;

the toner discharging structure further includes a push rod;

when the push rod is at a first position, the air duct is configured not to transmit the wind to the toner mixing unit; and when the push rod is at a second position, the air duct is configured to transmit the wind to the toner mixing unit.

15. The toner discharging structure according to claim 14, wherein:

a filter mesh or a check valve is disposed in the air duct.

16. The toner discharging structure according to claim 14, wherein:

the blowing blades are centrifugal blowing blades.

17. The toner discharging structure according to claim 14, wherein:

a toner outlet stirring plate is disposed inside the toner mixing unit;

the toner outlet stirring plate is configured to receive force from the cartridge body to rotate; and the toner outlet stirring plate overlaps the toner outlet in at least position when the toner outlet stirring plate rotates.

18. The toner discharging structure according to claim 17, wherein:

the toner outlet stirring plate is an elastic plate; and a protruding block is disposed at an inner wall of the toner mixing unit to allow the toner outlet stirring plate to deform.

19. The toner discharging structure according to claim 17, wherein:

the toner mixing unit further includes a toner guiding slope;

an angle between the toner guiding slope and a rotation axis of the cartridge body is an acute angle; and the toner outlet is located at a bottom of the toner guiding slope.

* * * * *